US009591938B2

(12) United States Patent
Andrews et al.

(10) Patent No.: US 9,591,938 B2
(45) Date of Patent: Mar. 14, 2017

(54) PURSE HOOKS, AND METHODS OF MAKING AND USING PURSE HOOKS

(71) Applicants: Lawrence Andrews, Covington, GA (US); Anthony R. Bradley, McDonough, GA (US)

(72) Inventors: Lawrence Andrews, Covington, GA (US); Anthony R. Bradley, McDonough, GA (US)

( * ) Notice: Subject to any disclaimer, the term of this patent is extended or adjusted under 35 U.S.C. 154(b) by 0 days.

(21) Appl. No.: 14/597,184

(22) Filed: Jan. 14, 2015

(65) Prior Publication Data

US 2015/0196152 A1 Jul. 16, 2015

Related U.S. Application Data

(60) Provisional application No. 61/927,086, filed on Jan. 14, 2014.

(51) Int. Cl.

| | |
|---|---|
| ***B65B 67/12*** | (2006.01) |
| ***A47G 29/08*** | (2006.01) |
| *A47G 25/06* | (2006.01) |

(52) U.S. Cl.

CPC ..... *A47G 29/083* (2013.01); *A47G 25/0607* (2013.01)

(58) Field of Classification Search

USPC ..... 248/304, 305, 306, 307, 308, 339, 215, 248/690, 691

See application file for complete search history.

(56) References Cited

U.S. PATENT DOCUMENTS

| | | | | |
|---|---|---|---|---|
| 2,154,161 | A | 9/1938 | Heckman | |
| 3,223,375 | A * | 12/1965 | Bernasconi | B60P 7/0807 248/308 |
| 4,118,001 | A | 10/1978 | Serkez | |
| 4,210,302 | A | 7/1980 | Serkez | |
| 4,312,455 | A | 1/1982 | Weber | |
| 4,978,093 | A | 12/1990 | Kennedy | |
| 5,594,419 | A | 1/1997 | Lo | |
| 6,070,303 | A | 6/2000 | Macy et al. | |
| 6,092,779 | A | 7/2000 | Depew et al. | |
| 6,109,579 | A | 8/2000 | Huang | |
| 6,345,796 | B1 | 2/2002 | Neuman | |
| 6,382,481 | B1 | 5/2002 | McIlmoil | |
| 6,481,680 | B2 | 11/2002 | Neuman | |
| 7,175,143 | B1 | 2/2007 | Ho | |
| 7,219,868 | B2 | 5/2007 | Marler et al. | |
| 7,234,672 | B1 | 6/2007 | Osterholt et al. | |
| 7,389,966 | B1 | 6/2008 | Hunter | |
| 7,429,024 | B2 | 9/2008 | Bokland-Moran | |
| 7,516,929 | B2 | 4/2009 | Brustein et al. | |
| 7,644,900 | B2 | 1/2010 | Yap et al. | |
| 7,681,851 | B1 | 3/2010 | Osterholt et al. | |
| 7,837,171 | B1 | 11/2010 | Otake | |
| 7,934,692 | B2 | 5/2011 | Brunstein et al. | |
| 2006/0054761 | A1 * | 3/2006 | Marler | A47G 29/083 248/304 |

* cited by examiner

*Primary Examiner* — Joanne Silbermann
(74) *Attorney, Agent, or Firm* — Withers & Keys, LLC

(57) ABSTRACT

Purse hooks are disclosed. Methods of making and using purse hooks are also disclosed.

20 Claims, 11 Drawing Sheets

PURSE HOOKS, AND METHODS OF MAKING AND USING PURSE HOOKS

CROSS-REFERENCE TO RELATED APPLICATIONS

This patent application claims the benefit of priority to U.S. provisional patent application Ser. No. 61/927,086 entitled "PURSE HOOKS, AND METHODS OF MAKING AND USING PURSE HOOKS" filed on Jan. 14, 2014, the subject matter of which is incorporated herein in its entirety.

FIELD OF THE INVENTION

The present invention relates to purse hooks, methods of making purse hooks, and methods of using purse hooks.

BACKGROUND OF THE INVENTION

Efforts continue to provide more effective and efficient devices for temporarily storing a purse (or other object), for example, when at a dinner table. Known devices are capable of temporarily storing a purse (or other object); however, known devices have one or more shortcomings including, but not limited to, (1) the design of the device is too complicated to make the device commercially viable, (2) the design of the device has an undesirable overall thickness, (3) the device has an unappealing appearance, and/or (4) design of the device is stationary and an obstruction.

What is needed in the art is an aesthetically pleasing purse hook that effectively and efficiently supports a purse or similar object.

SUMMARY OF THE INVENTION

The present invention is directed to purse hooks. The purse hooks of the present invention provide one or more of the following features: (1) an aesthetically pleasing look; (2) a functional construction with a purse hook housing having a relatively small thickness; (3) a default position of a hook member within a purse hook housing, (4) a use position in which a majority of a length of the hook member extends from the purse hook housing, (5) versatility with regard to suitable substrates onto which the purse hook housing may be mounted (e.g., the underside of a table, a wall surface, etc.), and (6) a simplicity of design that enables economical production of the purse hook.

According to one exemplary embodiment of the present invention, the purse hook of the present invention comprises: (I) a purse hook housing comprising: (1) a housing front surface, a housing rear surface opposite the housing front surface, and a housing peripheral surface connecting the housing front surface to the housing rear surface, the housing peripheral surface representing an overall housing thickness $t_{phh}$ of the purse hook housing; and (2) a hook channel extending within the housing front surface, the hook channel having (i) a channel depth $d_{hc}$ that is equal to or less than the overall housing thickness $t_{phh}$ of the purse hook housing, and (ii) a channel shape; and (II) a hook member attached to the purse hook housing, the hook member having a hook size and shape so as to enable the hook member to move from (a) a housed position in which an inner peripheral side surface of the hook member is adjacent to at least one of: (1) the housing peripheral surface and (2) an outwardly-facing channel wall of the hook channel to (b) a use position in which the inner peripheral side surface of the hook member is not adjacent to and is positioned a distance away from at least one of: (1) the housing peripheral surface and (2) the outwardly-facing channel wall.

In another exemplary embodiment of the present invention, the purse hook of the present invention comprises: (I) a purse hook housing comprising: (1) a housing front surface, a housing rear surface opposite the housing front surface, and a housing peripheral surface connecting the housing front surface to the housing rear surface, the housing peripheral surface representing an overall housing thickness $t_{phh}$ of the purse hook housing; (2) a hook channel extending within the housing front surface, the hook channel having (i) a channel depth $d_{hc}$ that is less than the overall housing thickness $t_{phh}$ of the purse hook housing, and (ii) a channel shape; and (3) a housing aperture extending through the purse hook housing from the housing front surface to the housing rear surface, the housing aperture being in communication with the hook channel (i.e., at least a portion of the hook channel intersects with the hook aperture); and (II) a hook member attached to the purse hook housing, the hook member having a hook size and shape so as to enable the hook member to move from a housed position within the hook channel to a use position in which the hook member is positioned outside of the purse hook housing.

In yet another exemplary embodiment of the present invention, the purse hook of the present invention comprises: (I) a purse hook housing comprising: (1) a housing front surface, a housing rear surface opposite the housing front surface, and a housing peripheral surface connecting the housing front surface to the housing rear surface, the housing peripheral surface representing an overall housing thickness $t_{phh}$ of the purse hook housing; and (2) a hook channel extending within the housing front surface, the hook channel having (i) a channel depth $d_{hc}$ that is equal to or less than the overall housing thickness $t_{phh}$ of the purse hook housing, and (ii) a channel shape; and (II) a hook member having a hook size and shape so as to enable the hook member to move from a housed position within the hook channel to a use position in which the hook member is positioned outside of the purse hook housing, the hook member comprising (i) a first hook member end, (ii) a second hook member end connected to the purse hook housing, and (iii) two hook member extensions extending away from the first hook member end.

In yet another exemplary embodiment of the present invention, the purse hook of the present invention comprises: (I) a purse hook housing comprising: (1) a housing front surface, a housing rear surface opposite the housing front surface, and a housing peripheral surface connecting the housing front surface to the housing rear surface, the housing peripheral surface representing an overall housing thickness $t_{phh}$ of the purse hook housing; and (2) a hook channel extending within the housing front surface, the hook channel having (i) a channel depth $d_{hc}$ that is equal to or less than the overall housing thickness $t_{phh}$ of the purse hook housing, and (ii) a channel shape; and (II) a hook member having a hook size and shape so as to enable the hook member to move from a housed position within the hook channel to a use position in which the hook member is positioned outside of the purse hook housing, the hook member comprising (i) a first hook member end comprising two hook components extending in opposite directions towards outer edges of the purse hook housing from a centrally located hook connecting component, the centrally located hook connecting component extending to (ii) a second hook member end connected to the purse hook housing.

In yet another exemplary embodiment of the present invention, the purse hook of the present invention comprises: (I) a purse hook housing comprising: (1) a housing front surface, a housing rear surface opposite the housing front surface, and a housing peripheral surface connecting the housing front surface to the housing rear surface, the housing peripheral surface representing an overall housing thickness $t_{phh}$ of the purse hook housing; and (2) a hook channel extending within the housing front surface, the hook channel having (i) a channel depth $d_{hc}$ that is equal to or less than the overall housing thickness $t_{phh}$ of the purse hook housing, and (ii) a channel shape; (II) a hook member having a hook size and shape so as to enable the hook member to move from a housed position within the hook channel to a use position in which the hook member is positioned outside of the purse hook housing, the hook member comprising (i) a first hook member end, and (ii) a second hook member end connected to the purse hook housing; and (III) a track system sized to attach to an underside of a table, the track system enabling the purse hook housing to move towards or away from an outer edge of the table by applying a moving force onto the purse hook housing.

The present invention is further directed to methods of making purse hooks. In one exemplary embodiment, the method of making a purse hook of the present invention comprises: (I) forming a purse hook housing comprising: (1) a housing front surface, a housing rear surface opposite the housing front surface, and a housing peripheral surface connecting the housing front surface to the housing rear surface, the housing peripheral surface representing an overall housing thickness $t_{phh}$ of the purse hook housing; and (2) a hook channel extending within the housing front surface, the hook channel having (i) a channel depth $d_{hc}$ that is equal to or less than the overall housing thickness $t_{phh}$ of the purse hook housing, and (ii) a channel shape; and (II) attaching a hook member to the purse hook housing, the hook member having a hook size and shape so as to enable the hook member to move from (a) a housed position in which an inner peripheral side surface of the hook member is adjacent to at least one of: (1) the housing peripheral surface and (2) an outwardly-facing channel wall of the hook channel to (b) a use position in which the inner peripheral side surface of the hook member is not adjacent to and is positioned a distance away from at least one of: (1) the housing peripheral surface and (2) the outwardly-facing channel wall.

In another exemplary embodiment, the method of making a purse hook of the present invention comprises: (I) forming a purse hook housing comprising: (1) a housing front surface, a housing rear surface opposite the housing front surface, and a housing peripheral surface connecting the housing front surface to the housing rear surface, the housing peripheral surface representing an overall housing thickness $t_{phh}$ of the purse hook housing; (2) a hook channel extending within the housing front surface, the hook channel having (i) a channel depth $d_{hc}$ that is less than the overall housing thickness $t_{phh}$ of the purse hook housing, and (ii) a channel shape; and (3) a housing aperture extending through the purse hook housing from the housing front surface to the housing rear surface, the housing aperture being in communication with the hook channel (i.e., at least a portion of the hook channel intersects with the hook aperture); and (II) attaching a hook member to the purse hook housing, the hook member having a hook size and shape so as to enable the hook member to move from a housed position within the hook channel to a use position in which the hook member is positioned outside of the purse hook housing.

In another exemplary embodiment of the present invention, the method of making a purse hook of the present invention comprises: (I) forming a purse hook housing comprising: (1) a housing front surface, a housing rear surface opposite the housing front surface, and a housing peripheral surface connecting the housing front surface to the housing rear surface, the housing peripheral surface representing an overall housing thickness $t_{phh}$ of the purse hook housing; and (2) a hook channel extending within the housing front surface, the hook channel having (i) a channel depth $d_{hc}$ that is equal to or less than the overall housing thickness $t_{phh}$ of the purse hook housing, and (ii) a channel shape; (II) forming a hook member having a hook size and shape so as to enable the hook member to move from a housed position within the hook channel to a use position in which the hook member is positioned outside of the purse hook housing, the hook member comprising (i) a first hook member end that extends beyond the housing peripheral surface of the purse hook housing when the hook member is in the housed position, (ii) a second hook member end connected to the purse hook housing, and (iii) two hook member extensions extending away from the first hook member end; and (III) attaching the hook member to the purse hook housing via at least one connecting member extending through portions of each of the two hook member extensions and into side walls of the hook channel within the purse hook housing.

In yet another exemplary embodiment of the present invention, the method of making a purse hook of the present invention comprises: (I) forming a purse hook housing comprising: (1) a housing front surface, a housing rear surface opposite the housing front surface, and a housing peripheral surface connecting the housing front surface to the housing rear surface, the housing peripheral surface representing an overall housing thickness $t_{phh}$ of the purse hook housing; and (2) a hook channel extending within the housing front surface, the hook channel having (i) a channel depth $d_{hc}$ that is equal to or less than the overall housing thickness $t_{phh}$ of the purse hook housing, and (ii) a channel shape; (II) forming a hook member having a hook size and shape so as to enable the hook member to move from a housed position within the hook channel to a use position in which the hook member is positioned outside of the purse hook housing, the hook member comprising (i) a first hook member end comprising two hook components extending in opposite directions towards outer edges of the purse hook housing from a centrally located hook connecting component, the centrally located hook connecting component extending to (ii) a second hook member end connected to the purse hook housing.

In yet another exemplary embodiment of the present invention, the method of making a purse hook of the present invention comprises: (I) forming a purse hook housing comprising: (1) a housing front surface, a housing rear surface opposite the housing front surface, and a housing peripheral surface connecting the housing front surface to the housing rear surface, the housing peripheral surface representing an overall housing thickness $t_{phh}$ of the purse hook housing; and (2) a hook channel extending within the housing front surface, the hook channel having (i) a channel depth $d_{hc}$ that is equal to or less than the overall housing thickness $t_{phh}$ of the purse hook housing, and (ii) a channel shape; (II) forming a hook member having a hook size and shape so as to enable the hook member to move from a housed position within the hook channel to a use position in which the hook member is positioned outside of the purse hook housing, the hook member comprising (i) a first hook member end, and (ii) a second hook member end connected to the purse hook housing; and (III) providing a track system sized to attach to an underside of a table, the track system enabling the purse hook housing to move towards or away from an outer edge of the table by applying a moving force onto the purse hook housing.

The present invention is even further directed to methods of using purse hooks. In one exemplary embodiment, the method of using a purse hook comprises: attaching one of the herein-described purse hook to a substrate (e.g., a wall surface, a table surface, a bar surface, a ceiling surface, or a desk surface). The methods of using a purse hook may comprise additional steps including, but not limited to, apply a moving force onto the hook member so as to move the hook member from the housed position so that a majority of the hook member extends from the purse hook housing; and positioning a portion of an object (e.g., a purse, a computer bag, a cell phone case component, a suitcase, or an umbrella) over the hook member extending from the purse hook housing.

These and other features and advantages of the present invention will become apparent after a review of the following detailed description of the disclosed embodiments and the appended claims.

BRIEF DESCRIPTION OF THE FIGURES

The present invention is further described with reference to the appended figures, wherein.

DETAILED DESCRIPTION OF THE INVENTION

Figure 1:
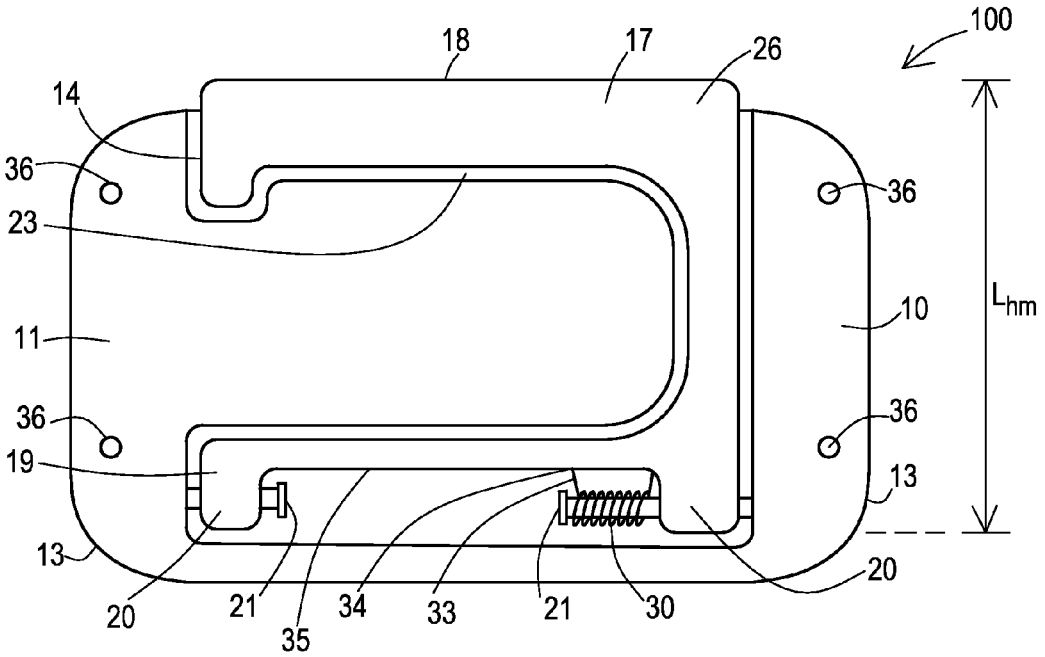
FIG. 1 depicts a frontal view of an exemplary purse hook of the present invention.

The present invention is directed to purse hooks. The present invention is further directed to methods of making and using a purse hook.

FIGS. 1-17 depict various views of an exemplary purse hook 100 of the present invention. As shown in FIGS. 1-17, exemplary purse hook 100 comprises a purse hook housing 10 comprising: (1) a housing front surface 11, a housing rear surface 12 opposite housing front surface 11, and a housing peripheral surface 13 connecting housing front surface 11 to housing rear surface 12, housing peripheral surface 13 representing an overall housing thickness $t_{phh}$ of purse hook housing 10. Exemplary purse hook 100 further comprises a hook channel 14 extending within housing front surface 11, hook channel 14 having (i) a channel depth $d_{hc}$ that is equal to or less than overall housing thickness $t_{phh}$ of purse hook housing 10, and (ii) a channel shape.

Exemplary purse hook 100 further comprise a hook member 17 attached to purse hook housing 10, hook member 17 having a hook size and shape so as to enable hook member to move from a housed position within hook channel 14 to a use position in which hook member 17 is positioned outside of purse hook housing 10.

Figure 7:
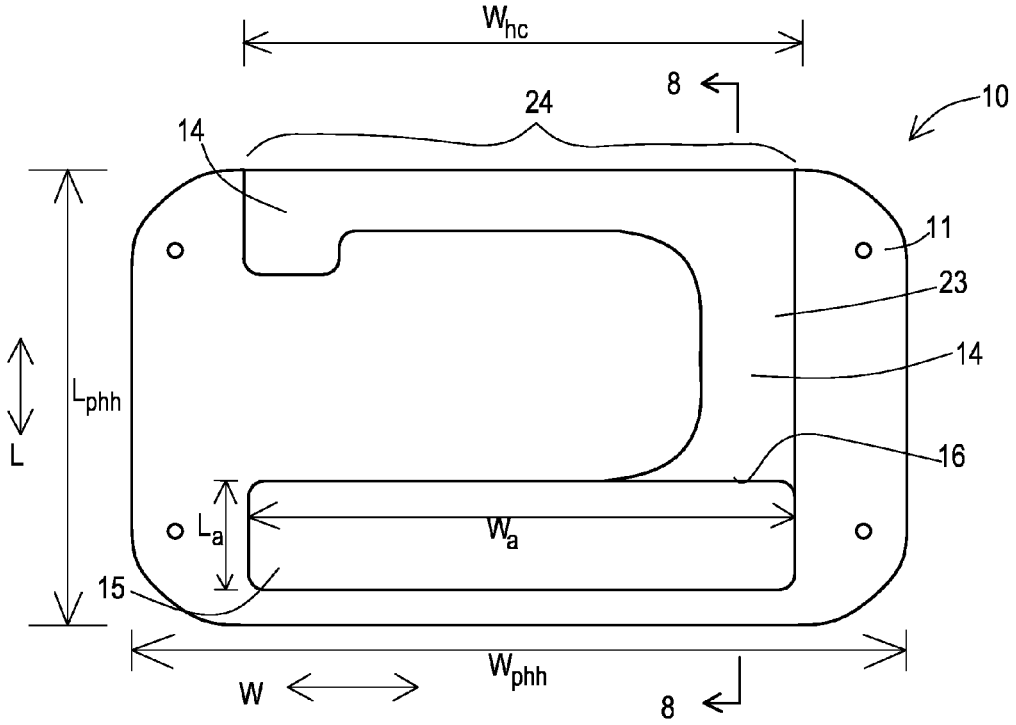
FIG. 7 depicts a frontal view of an exemplary purse hook housing suitable for use in the exemplary purse hook shown in FIG. 1.

As shown in FIGS. 1-10, in some embodiments, purse hooks of the present invention, like exemplary purse hook 100, further comprise a housing aperture 15 extending through purse hook housing 10 from housing front surface 11 to housing rear surface 12, housing aperture 15 being in communication with hook channel 14 (i.e., housing aperture 15 and hook channel 14 share a channel edge 16; see, FIG. 7). In other embodiments, purse hooks of the present invention have a hook channel, such as hook channel 14, without aperture 15 extending from channel floor 23 to housing rear surface 12.

As shown in FIGS. 1-17, in some embodiments, purse hooks of the present invention, like exemplary purse hook 100, may comprise a hook member 17 comprising (i) a first hook member end 18 that extends beyond housing peripheral surface 13 of purse hook housing 10 when hook member 17 is in the housed position, (ii) a second hook member end 19 connected to purse hook housing 10, and (iii) two hook member extensions 20 extending away from first hook member end 18.

As shown in FIGS. 1-17, in some embodiments, purse hooks of the present invention, like exemplary purse hook 100, may comprise at least one connecting member 21 extending through a portion or portions of hook member 17 and in some embodiments through each of two hook member extensions 20 and into side walls 22 of hook channel 14 within purse hook housing 10.

Figure 11:
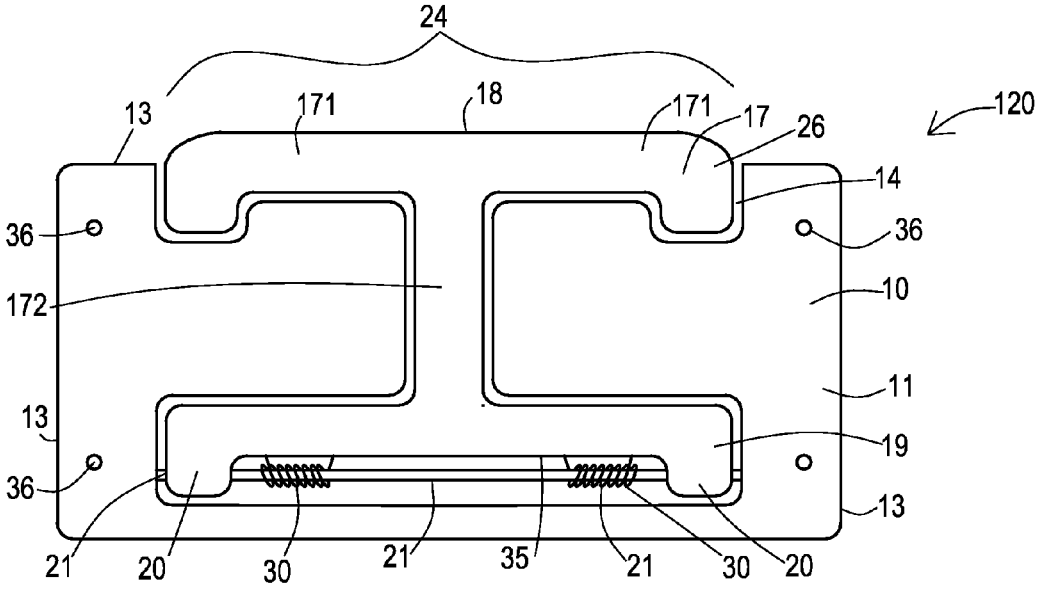
FIG. 11 depicts a frontal view of another exemplary purse hook of the present invention.

As shown in FIG. 11, in some embodiments, purse hooks of the present invention, like exemplary purse hook 120, may comprise (i) a first hook member end 18 comprising two hook components 171 extending in opposite directions towards outer edges of the purse hook housing 10 from a centrally located hook connecting component 172, the centrally located hook connecting component 172 extending to (ii) a second hook member end 19 connected to the purse hook housing 10.

Figure 12:
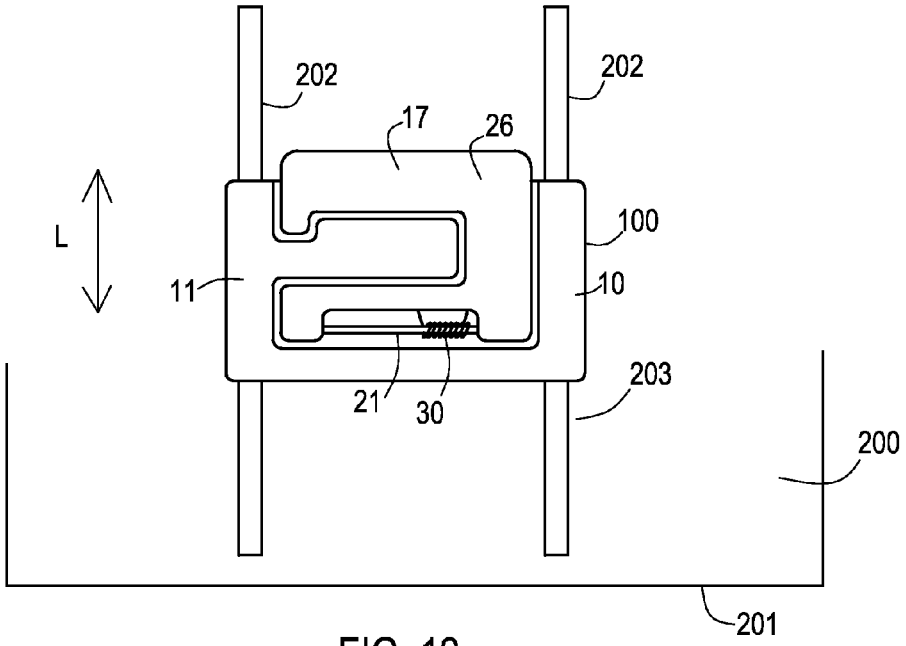
FIG. 12 depicts a view of an exemplary purse hook of the present invention that is movable along a lower surface of a table.
Figure 13:
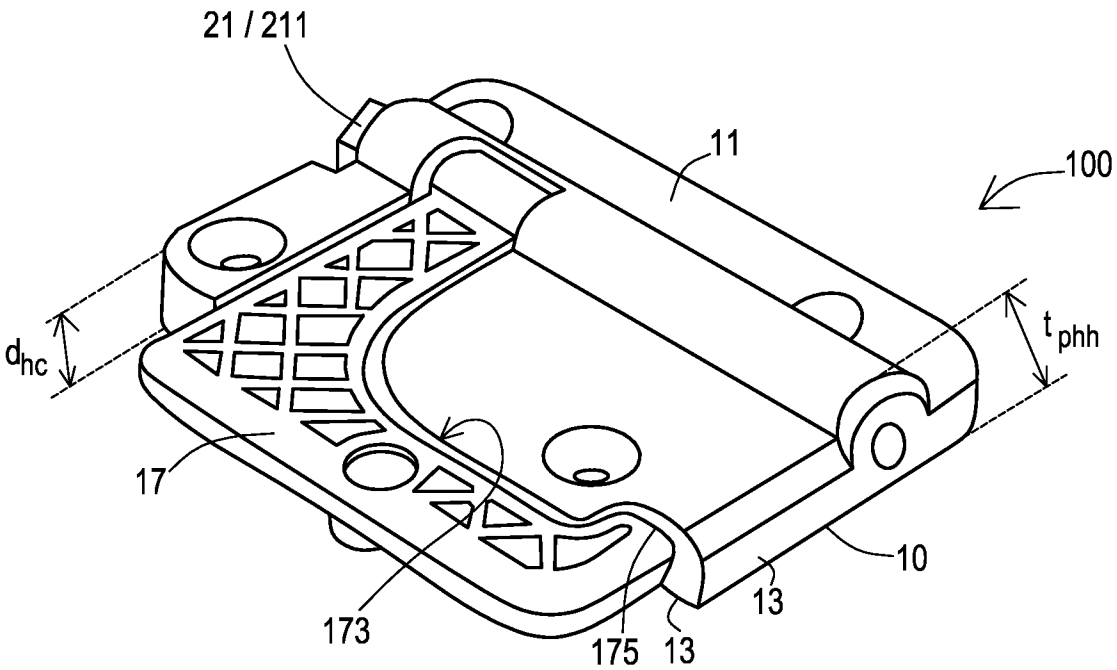
FIG. 13 depicts a perspective top view of another exemplary purse hook of the present invention.
Figure 14A:
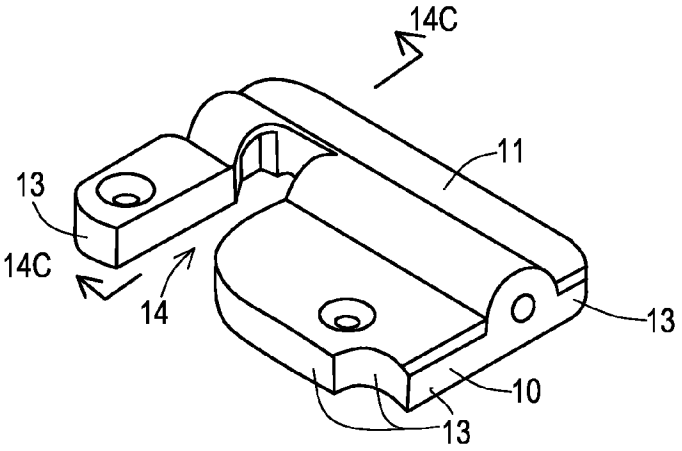
FIGS. 14A-14C depict perspective top and bottom views and a side cross-sectional view of the exemplary purse hook housing of the exemplary purse hook shown in FIG. 13.
Figure 14C:
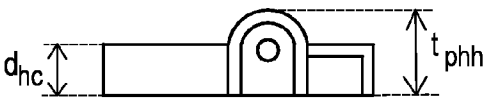
Figure 14B:
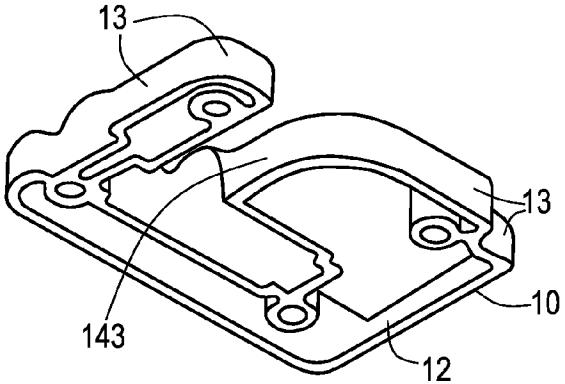
Figure 15:
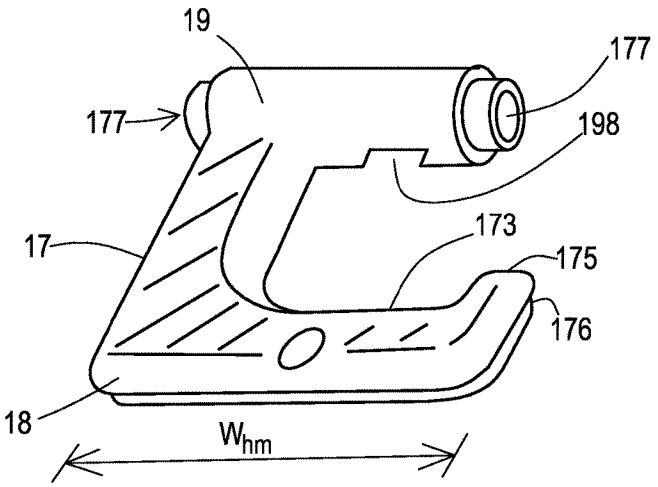
FIG. 15 depicts a perspective view of the exemplary hook member of the exemplary purse hook shown in FIG. 13.

As shown in FIG. 12, in some embodiments, purse hooks of the present invention, like exemplary purse hook 100 or 120, may further comprise a track system 202 sized to attach to an underside 203 of a table 200, the track system 202 enabling the purse hook housing 10 to move towards or away from an outer edge 201 of the table 200 (i.e., in direction L as shown in FIG. 12) by applying a moving force onto the purse hook housing 10.

As shown in FIGS. 13-17, in some embodiments, purse hooks of the present invention, like exemplary purse hook 100, may comprise a hook member 17 attached to the purse hook housing 10, wherein the hook member 17 has a hook size and shape so as to enable the hook member 17 to move from (a) a housed position in which an inner peripheral side surface 173 of the hook member 17 is adjacent to at least one of: (1) the housing peripheral surface 13 and (2) an outwardly-facing channel wall 143 of the hook channel 14 to (b) a use position in which the inner peripheral side surface 173 of the hook member 17 is not adjacent to and is positioned a distance away from at least one of: (1) the housing peripheral surface 13 and (2) the outwardly-facing channel wall 143.

The present invention is further directed to methods of making and using any of the herein disclosed purse hooks and purse hook components. It should be understood that any forming step may comprise conventional thermoforming step(s), for example, a single injection molding step to make a given component (e.g., purse hook housing or hook member). Other conventional process steps that may be used to form the purse hook and purse hook components of the present invention may include, but are not limited to, a cutting step; a drilling step (e.g., to form holes through the purse hook housing); a machining step (e.g., any step to smooth and/or curve edges of a given component); and one or more assembling steps (e.g., combining and/or attaching one of more components with one another).

As discussed herein, the purse hook 100 of the present invention may comprise a number of components. A description of individual components and combinations of individual components is provided in the embodiments below. In addition, a description of methods of making and using purse hook 100 of the present invention is provided in the embodiments below.

EMBODIMENTS

Purse Hooks:

1. A purse hook 100 comprising: (I) a purse hook housing 10 comprising: (1) a housing front surface 11, a housing rear surface 12 opposite said housing front surface 11, and a housing peripheral surface 13 connecting said housing front surface 11 to said housing rear surface 12, said housing peripheral surface 13 representing an overall housing thickness $t_{phh}$ of said purse hook housing 10; and (2) a hook channel 14 extending within said housing front surface 11, said hook channel 14 having (i) a channel depth $d_{hc}$ that is equal to or less than said overall housing thickness $t_{phh}$ of said purse hook housing 10, and (ii) a channel shape; and (II) a hook member 17 attached to said purse hook housing 10, said hook member 17 having a hook size and shape so as to enable said hook member 17 to move from (a) a housed position in which an inner peripheral side surface 173 of said hook member 17 is adjacent to at least one of: (1) said housing peripheral surface 13 and (2) an outwardly-facing channel wall 143 of said hook channel 14 to (b) a use position in which said inner peripheral side surface 173 of said hook member 17 is not adjacent to and is positioned a distance away from at least one of: (1) said housing peripheral surface 13 and (2) said outwardly-facing channel wall 143.

Figure 8:
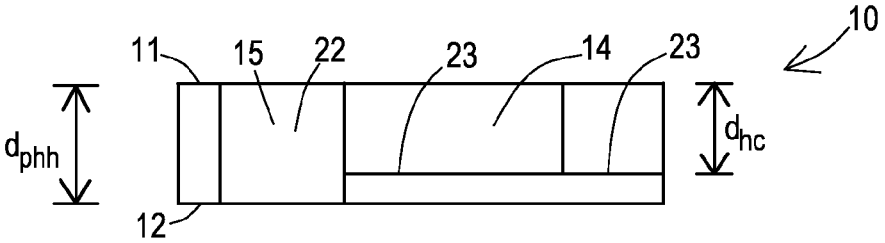
FIG. 8 depicts a cross-sectional view of the exemplary purse hook housing shown in FIG. 7 as viewed along line 8-8 shown in FIG. 7.

2. A purse hook 100 comprising: (I) a purse hook housing 10 comprising: (1) a housing front surface 11, a housing rear surface 12 opposite said housing front surface 11, and a housing peripheral surface 13 connecting said housing front surface 11 to said housing rear surface 12, said housing peripheral surface 13 representing an overall housing thickness $t_{phh}$ of said purse hook housing 10; (2) a hook channel 14 extending within said housing front surface 11, said hook channel 14 having (i) a channel depth $d_{hc}$ that is less than said overall housing thickness $t_{phh}$ of said purse hook housing 10, and (ii) a channel shape; and (3) a housing aperture 15 extending through said purse hook housing 10 from said housing front surface 11 to said housing rear surface 12, said housing aperture 15 being in communication with said hook channel 14; and (II) a hook member 17 attached to said purse hook housing 10, said hook member 17 having a hook size and shape so as to enable said hook member 17 to move from (a) a housed position (as shown in FIGS. 1-6) within said purse hook housing 10 to (b) a use position in which said hook member 17 is positioned outside of said purse hook housing 10. As used herein, the phrase "said housing aperture 15 being in communication with said hook channel 14" refers to hook channel 14 extending to housing aperture 15 (or vice versa) such that hook channel 14 and housing aperture 15 share a channel floor edge 16 and side wall 22 as shown in FIGS. 7-8. In other words, hook channel 14 and housing aperture 15 intersect one another within the bounds of peripheral surface 13.

Figure 9:
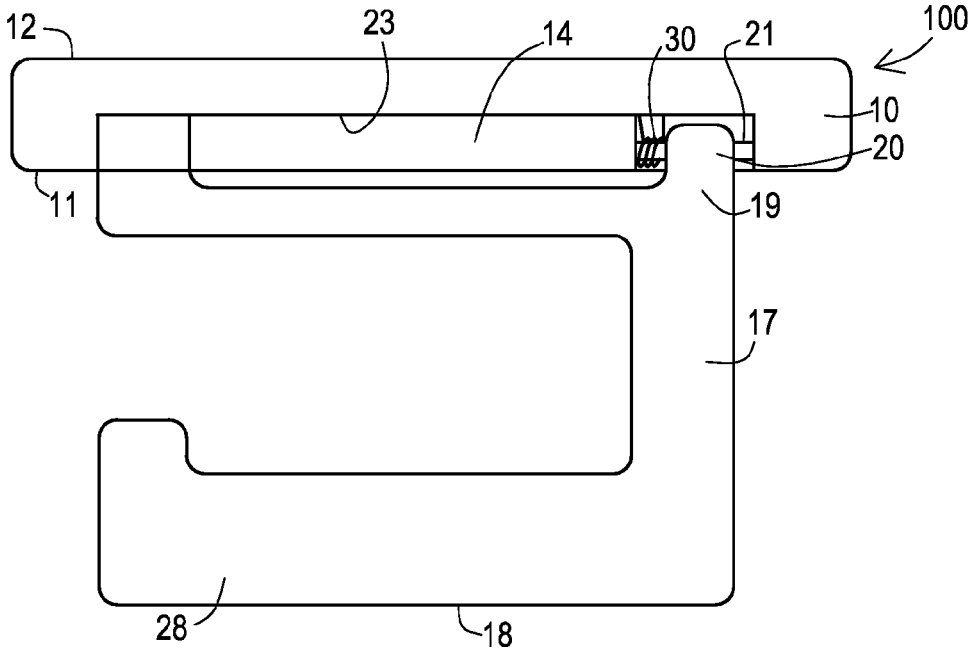
FIG. 9 depicts a side view of the exemplary purse hook shown in FIG. 1 with the hook member positioned outside of the purse hook housing as viewed along a top view (i.e., the same view as shown in FIG. 3)
Figure 10:
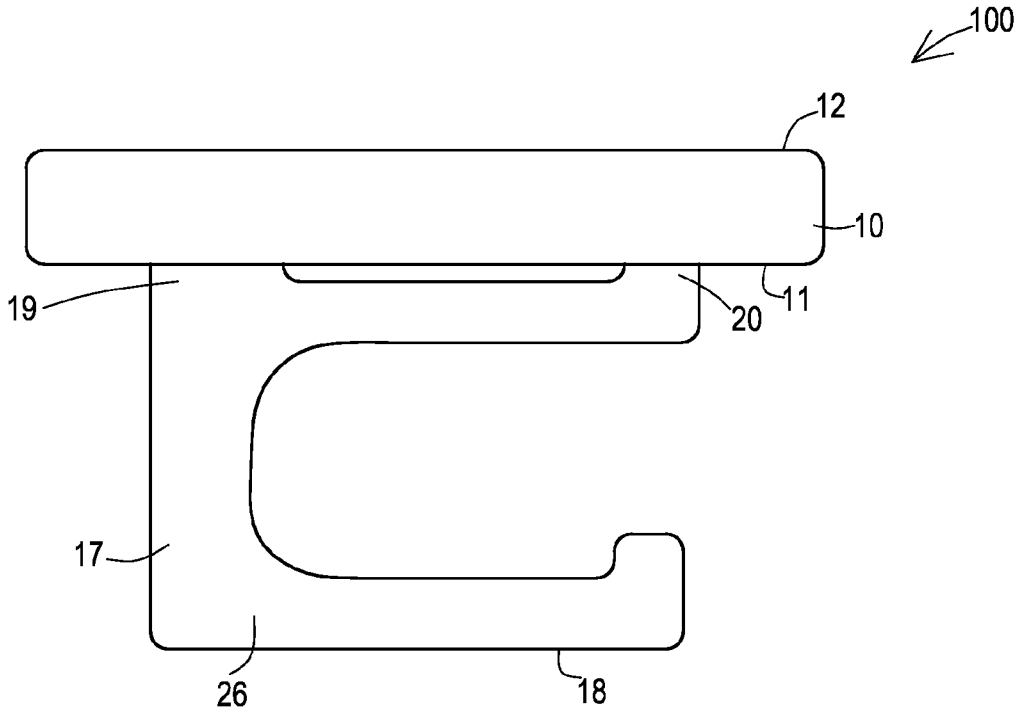
FIG. 10 depicts a side view of the exemplary purse hook shown in FIG. 1 with the hook member positioned outside of the purse hook housing as viewed along a bottom view (i.e., the same view as shown in FIG. 4)

3. A purse hook 100 comprising: (I) a purse hook housing 10 comprising: (1) a housing front surface 11, a housing rear surface 12 opposite said housing front surface 11, and a housing peripheral surface 13 connecting said housing front surface 11 to said housing rear surface 12, said housing peripheral surface 13 representing an overall housing thickness $t_{phh}$ of said purse hook housing 10; and (2) a hook channel 14 extending within said housing front surface 11, said hook channel 14 having (i) a channel depth $d_{hc}$ that is equal to or less than said overall housing thickness $t_{phh}$ of said purse hook housing 10, and (ii) a channel shape; and (II) a hook member 17 having a hook size and shape so as to enable said hook member 17 to move from (a) a housed position (as shown in FIGS. 1-6) within said purse hook housing 10 to (b) a use position in which said hook member 17 is positioned outside of said purse hook housing 10 (as shown in FIGS. 9-10), said hook member 17 comprising (i) a first hook member end 18, (ii) a second hook member end 19 connected to said purse hook housing 10, and (iii) two hook member extensions 20 extending away from said first hook member end 18.

4. A purse hook 100 comprising: (I) a purse hook housing 10 comprising: (1) a housing front surface 11, a housing rear surface 12 opposite said housing front surface 11, and a housing peripheral surface 13 connecting said housing front surface 11 to said housing rear surface 12, said housing peripheral surface 13 representing an overall housing thickness $t_{phh}$ of said purse hook housing 10; and (2) a hook channel 14 extending within said housing front surface 11, said hook channel 14 having (i) a channel depth $d_{hc}$ that is equal to or less than said overall housing thickness $t_{phh}$ of said purse hook housing 10, and (ii) a channel shape; and (II) a hook member 17 having a hook size and shape so as to enable said hook member 17 to move from (a) a housed position within said purse hook housing 10 to (b) a use position in which said hook member 17 is positioned outside of said purse hook housing 10, said hook member 17 comprising (i) a first hook member end 18 comprising two hook components 171 extending in opposite directions towards outer edges of said purse hook housing 10 from a centrally located hook connecting component 172, said centrally located hook connecting component 172 extending to (ii) a second hook member end 19 connected to said purse hook housing 10. See, for example, hook member 17 shown in FIG. 11.

5. A purse hook 100 comprising: (I) a purse hook housing 10 comprising: (1) a housing front surface 11, a housing rear surface 12 opposite said housing front surface 11, and a housing peripheral surface 13 connecting said housing front surface 11 to said housing rear surface 12, said housing peripheral surface 13 representing an overall housing thickness $t_{phh}$ of said purse hook housing 10; and (2) a hook channel 14 extending within said housing front surface 11, said hook channel 14 having (i) a channel depth $d_{hc}$ that is equal to or less than said overall housing thickness $t_{phh}$ of said purse hook housing 10, and (ii) a channel shape; and (II) a hook member 17 having a hook size and shape so as to enable said hook member 17 to move from (a) a housed position within said purse hook housing 10 to (b) a use position in which said hook member 17 is positioned outside of said purse hook housing 10, said hook member 17 comprising (i) a first hook member end 18, and (ii) a second hook member end 19 connected to said purse hook housing 10; and (III) a track system 202 sized to attach to an underside 203 of a table 200, said track system 202 enabling said purse hook housing 10 to move towards or away from an outer edge 201 of the table 200 by applying a moving force onto said purse hook housing 10. See, for example, track system 202 shown in FIG. 12. It should be understood that any suitable track system 202 may be used as long as the track system (1) enables purse hook housing 10 to be attached thereto (e.g., via a connecting member such as a screw or via a corresponding track shape within housing rear surface 12 of purse hook housing 10), and (2) enables purse hook housing 10 to move along track system 202.

6. The purse hook 100 of any one of embodiments 2 to 5, said hook member 17 has a hook size and shape so as to enable said hook member 17 to move from (a) a housed position in which an inner peripheral side surface 173 of said hook member 17 is adjacent to at least one of: (1) said housing peripheral surface 13 and (2) an outwardly-facing channel wall 143 of said hook channel 14 to (b) a use position in which said inner peripheral side surface 173 of said hook member 17 is not adjacent to and is positioned a distance away from at least one of: (1) said housing peripheral surface 13 and (2) said outwardly-facing channel wall 143.

7. The purse hook 100 of embodiment 1 or 6, wherein when said hook member 17 is in the use position, said inner peripheral side surface 173 of said hook member 17 is pivotally positioned a distance from at least one of: (1) said housing peripheral surface 13 and (2) said outwardly-facing channel wall 143.

8. The purse hook 100 of any one of embodiments 1 and 6 to 7, wherein when said hook member 17 is in the use position 17*u*, said inner peripheral side surface 173 of said hook member 17 is positioned within a plane that forms an angle A with the housed position 17*h* of said hook member 17, said angle A being less than 180°. See, for example, FIG. 14C.

9. The purse hook 100 of any one of embodiments 1 and 6 to 8, wherein when said hook member 17 is in the use position 17*u*, said inner peripheral side surface 173 of said hook member 17 is positioned within a plane that forms an angle A with the housed position 17*h* of said hook member 17, said angle A ranging from about 45° to about 150°.

10. The purse hook 100 of any one of embodiments 1 and 6 to 9, wherein when said hook member 17 is in the use position 17*u*, said inner peripheral side surface 173 of said hook member 17 is positioned within a plane that forms an angle A with the housed position 17*h* of said hook member 17, said angle A being about 90°.

11. The purse hook 100 of any one of embodiments 1 and 3 to 10, wherein said hook channel 14 has a channel depth $d_{hc}$ that is equal to said overall housing thickness $t_{phh}$ of said purse hook housing 10.

12. The purse hook 100 of any one of embodiments 1 and 6 to 11, wherein said hook member 17 has a hook size and shape such that said inner peripheral side surface 173 of said hook member 17 is adjacent to said housing peripheral surface 13 when said hook member 17 is in the housed position, and said inner peripheral side surface 173 is positioned a distance away from said housing peripheral surface 13 when in the use position.

13. The purse hook 100 of any one of embodiments 1 and 6 to 12, wherein said hook member 17 comprises (i) a first hook member end 18 having a hook end tip 175, and (ii) a second hook member end 19 connected to said purse hook housing 10, and an inner peripheral side tip surface 176 of said hook end tip 175 is adjacent to said housing peripheral surface 13 when said hook member 17 is in the housed position, and said inner peripheral side tip surface 176 of said hook end tip 175 is positioned a distance away from said housing peripheral surface 13 when in the use position.

14. The purse hook 100 of any one of embodiments 1 and 6 to 13, wherein said housing peripheral surface 13 extends along first and second housing peripheral surface portions 13*a* and 13*b* on opposite sides of said hook housing 10, said inner peripheral side surface 173 of said hook member 17 is adjacent to and extends along one of said first and second housing peripheral surface portions 13*a* and 13*b*, and said first and second housing peripheral surface portions 13*a* and 13*b* of said hook housing 10 are substantially parallel with one another.

15. The purse hook 100 of any one of embodiments 1, 3 to 10 and 12 to 14, wherein said purse hook housing 10 further comprises a housing aperture 15 extending through said purse hook housing 10 from said housing front surface 11 to said housing rear surface 12, said housing aperture 15 being in communication with said hook channel 14.

16. The purse hook 100 of any one of embodiments 1 to 15, wherein said hook member 17 comprising (i) a first hook member end 18 that extends beyond said housing peripheral surface 13 of said purse hook housing 10 when said hook member 17 is in the housed position, and (ii) a second hook member end 19 connected to said purse hook housing 10.

17. The purse hook 100 of any one of embodiments 1 to 2 and 4 to 16, wherein said hook member 17 comprises two hook member extensions 20 extending away from said first hook member end 18.

18. The purse hook 100 of any one of embodiments 1 to 17, wherein said purse hook 100 further comprises: at least one connecting member 21 extending through said hook member 17 at said second hook member end 19.

19. The purse hook 100 of embodiment 18, wherein said at least one connecting member 21 extends through portions of each of said two hook member extensions 20 and into side walls 22 of said hook channel 14 within said purse hook housing 10.

20. The purse hook 100 of any one of embodiments 1 to 10 and 12 to 19, wherein said channel depth $d_{hc}$ extends into said housing front surface 11 a depth amount of up to about 70% of the overall housing thickness $t_{phh}$ of said purse hook housing 10.

21. The purse hook 100 of any one of embodiments 1 to 10 and 12 to 20, wherein said channel depth $d_{hc}$ extends into said housing front surface 11 a depth amount of from about 40% to about 60% of the overall housing thickness $t_{phh}$ of said purse hook housing 10.

22. The purse hook 100 of any one of embodiments 1 to 10 and 12 to 21, wherein said channel depth $d_{hc}$ extends into said housing front surface 11 a depth amount of from about 6.0 to about 8.0 mm.

23. The purse hook 100 of any one of embodiments 1 to 10 and 12 to 22, wherein said hook channel 14 has a channel floor 23 that is substantially within a first plane, said first plane being substantially parallel with (1) outermost portions of said housing front surface 11 and (2) said housing rear surface 12.

24. The purse hook 100 of any one of embodiments 1 to 23, wherein said channel shape, as viewed from said housing front surface 11, extends (i) along a portion 24 of said housing peripheral surface 13, said portion 24 of said housing peripheral surface 13 representing up to about 90% of an overall width $W_{phh}$ of said purse hook housing 10, and (ii) from said portion 24 of said housing peripheral surface 13 into said purse hook housing 10 in a length direction L, wherein at least a portion of said hook channel 14 extends at least 50% of an overall length $L_{phh}$ of said purse hook housing 10. See, for example, FIG. 7.

25. The purse hook 100 of any one of embodiments 1 to 24, wherein said channel shape, as viewed from said housing front surface 11, extends (i) along a portion 24 of said housing peripheral surface 13, said portion 24 of said housing peripheral surface 13 representing from about 60% to about 90% of an overall width $W_{phh}$ of said purse hook housing 10, and (ii) from said portion 24 of said housing peripheral surface 13 into said purse hook housing 10 in a length direction L, wherein at least a portion of said hook channel 14 extends from about 55% to about 75% of an overall length $L_{phh}$ of said purse hook housing 10.

26. The purse hook 100 of any one of embodiments 1 to 25, wherein said channel shape, as viewed from said housing front surface 11, extends (i) along a portion 24 of said housing peripheral surface 13, said portion 24 of said housing peripheral surface 13 representing about 75% of an overall width $W_{phh}$ of said purse hook housing 10, and (ii) from said portion 24 of said housing peripheral surface 13 into said purse hook housing 10 in a length direction L, wherein at least a portion of said hook channel 14 extends about 67% of an overall length $L_{phh}$ of said purse hook housing 10.

27. The purse hook 100 of any one of embodiments 1 to 10 and 12 to 26, wherein said channel shape extends from a portion 24 of said housing peripheral surface 13 to said housing aperture 15.

28. The purse hook 100 of any one of embodiments 1 to 10 and 12 to 27, wherein said housing aperture 15 has a rectangular shape with a longest dimension extending along a width $W_{phh}$ of said purse hook housing 10, and a smaller dimension extending along a length $L_{phh}$ of said purse hook housing 10.

29. The purse hook 100 of any one of embodiments 1 to 10 and 12 to 28, wherein said housing aperture 15 has an overall aperture width $W_a$ that is substantially equal to an overall channel width $W_{hc}$.

30. The purse hook 100 of any one of embodiments 24 to 29, wherein said housing aperture 15 has an overall aperture width $W_a$ that is substantially equal to said portion 24 of said peripheral surface 13.

31. The purse hook 100 of any one of embodiments 1 to 10 and 12 to 30, wherein said housing aperture 15 has an overall aperture length $L_a$ that is up to about 40% of an overall length $L_{phh}$ of said purse hook housing 10.

32. The purse hook 100 of any one of embodiments 1 to 10 and 12 to 31, wherein said housing aperture 15 has an overall aperture length $L_a$ that is about 28% of an overall length $L_{phh}$ of said purse hook housing 10.

33. The purse hook 100 of any one of embodiments 1 to 32, wherein said channel shape, as viewed from said housing front surface 11, has a J-shape.

34. The purse hook 100 of any one of embodiments 1 to 33, wherein said hook member 17 has (i) a first major surface 26 extending along an outer surface 26 of said hook member 17 when said hook member 17 is in said housed position, and (ii) a second major surface 28 opposite said first major surface 26, said second major surface 28 extending along said hook channel 14 when said hook member 17 is in said housed position. It should be noted that inner peripheral side surface 173 of hook member 17 separates a portion of first major surface 26 from a portion of second major surface 28 along hook member 17.

35. The purse hook 100 of any one of embodiments 1 to 34, wherein said hook member 17 has (i) a first major surface 26 extending along an outer surface 26 of said hook member 17 when said hook member 17 is in said housed position, and (ii) a second major surface 28 opposite said first major surface 26, said second major surface 28 extending along said hook channel 14 when said hook member 17 is in said housed position, said first major surface 26 and said second major surface 28 both being substantially flat with said first major surface 26 being in a second plane and said second major surface 28 being in a third plane, said second and third planes being substantially parallel with one another.

36. The purse hook 100 of any one of embodiments 1 to 3 and 5 to 35, wherein said hook member 17 has (i) a first hook member end 18 comprising two hook components 171 extending in opposite directions towards outer edges of said purse hook housing 10 from a centrally located hook connecting component 172, said centrally located hook connecting component 172 extending to (ii) a second hook member end 19 connected to said purse hook housing 10.

37. The purse hook 100 of any one of embodiments 1 to 36, wherein said hook member 17 has an overall thickness $t_{hm}$ that is less than about 90% of the overall housing thickness $t_{phh}$ of said purse hook housing 10 (or an overall thickness $t_{hm}$ that is any percent less than about 90%, in increments of 1.0%, down to about 5.0% of the overall housing thickness $t_{phh}$ of said purse hook housing 10)

38. The purse hook 100 of any one of embodiments 1 to 37, wherein said hook member 17 has an overall thickness $t_{hm}$ that is from about 30% to about 50% of the overall housing thickness $t_{phh}$ of said purse hook housing 10.

39. The purse hook 100 of any one of embodiments 1 to 38, wherein said hook member 17 has an overall thickness $t_{hm}$ that is about 40% of the overall housing thickness $t_{phh}$ of said purse hook housing 10.

40. The purse hook 100 of any one of embodiments 18 to 39, wherein said at least one connecting member 21 comprises a single connecting member 21.

41. The purse hook 100 of embodiment 40, wherein said single connecting member 21 comprises a bolt-like member 211 with a threaded end 212, said bolt-like member 211 extending thru a hook member hole 177 extending along a width of said hook member 17. In one exemplary embodiment shown in FIGS. 16-17, bolt-like member 211 with threaded end 212 comprises a 3 inch×¼ inch bolt.

42. The purse hook 100 of any one of embodiments 18 to 39, wherein said at least one connecting member 21 comprises two separate connecting members 21.

43. The purse hook 100 of embodiment 42, wherein each of the two separate connecting members 21 comprises a screw 21.

44. The purse hook 100 of any one of embodiments 1 to 43, further comprising at least one tensioning device 30 that applies a housing force onto said hook member 17 so as to keep said hook member 17 within said hook channel 14, in the use position, until an outside force moves said hook member 17 out of the use position.

45. The purse hook 100 of any one of embodiments 1 to 44, further comprising two tensioning devices 30 that each apply a housing force onto said hook member 17 so as to keep said hook member 17 within said hook channel 14, in the use position, until an outside force moves said hook member 17 out of the use position.

46. The purse hook 100 of any one of embodiments 1 to 44, further comprising a single tensioning device 30 that applies a housing force onto said hook member 17 so as to keep said hook member 17 within said hook channel 14, in the use position, until an outside force moves said hook member 17 out of the use position.

47. The purse hook 100 of any one of embodiments 44 to 46, wherein each tensioning device 30 is positioned along said at least one connecting member 21.

48. The purse hook 100 of any one of embodiments 44 to 47, wherein each tensioning device 30 comprises a spring 30. In one exemplary embodiment (shown in FIGS. 16-17), spring 30 comprises a 180 degree torsion spring having a first spring leg (i.e., first end 31) with a leg length of about 1.0 inch and a shortened second spring leg (i.e., second end 33) with a leg length of about 0.15 inch (about 3.8 mm) and curved slightly.

Figure 2:
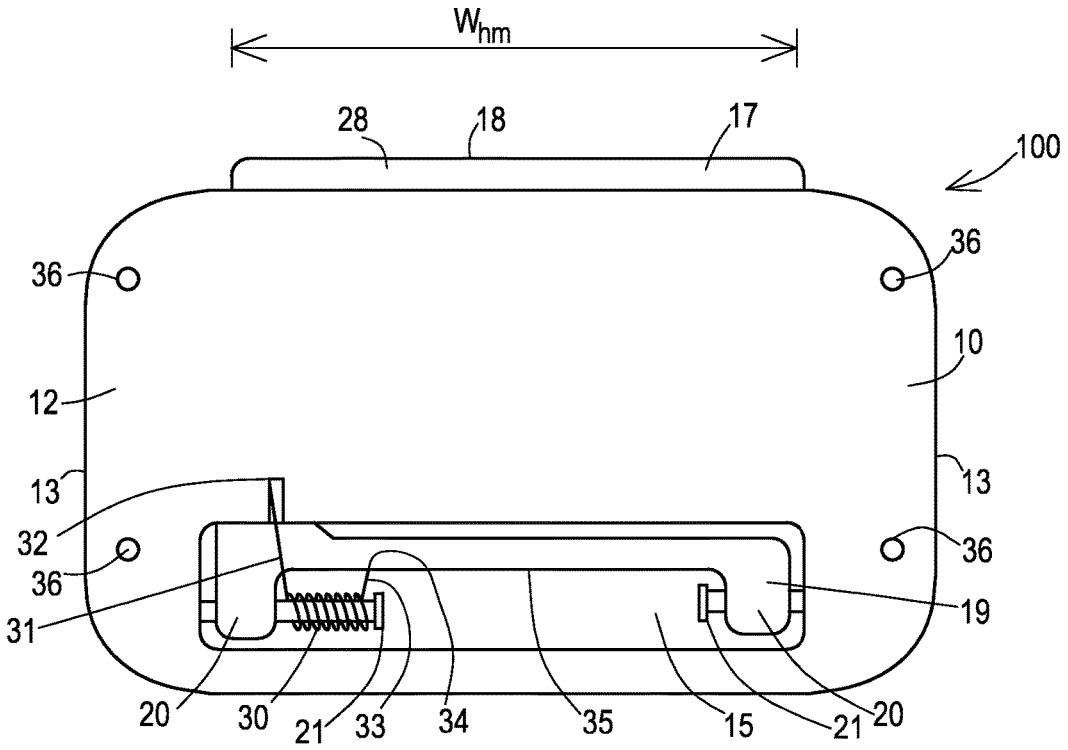
FIG. 2 depicts a rear view of the exemplary purse hook shown in FIG. 1.
Figure 3:
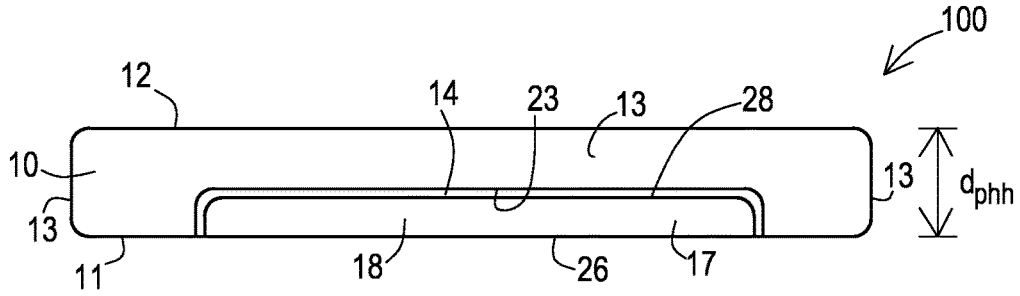
FIG. 3 depicts a top view of the exemplary purse hook shown in FIG. 1.
Figure 4:
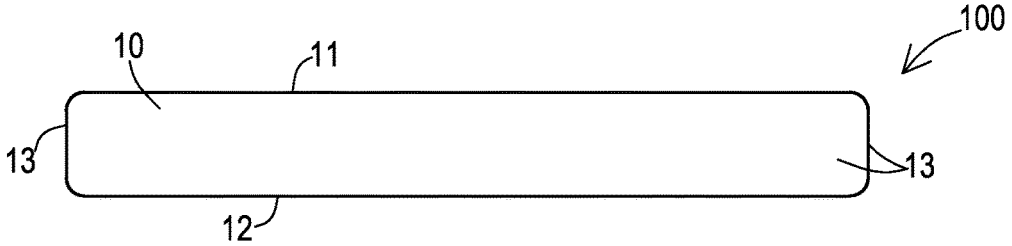
FIG. 4 depicts a bottom view of the exemplary purse hook shown in FIG. 1.
Figure 5:
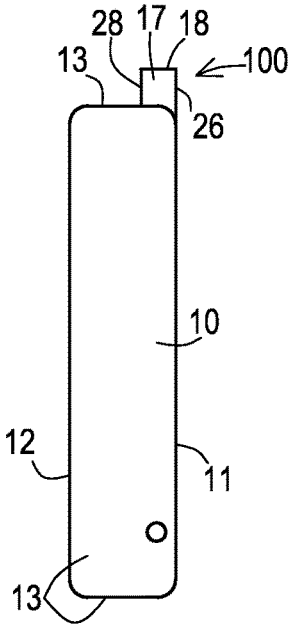
FIG. 5 depicts a side view of the exemplary purse hook shown in FIG. 1 as viewed from a left-hand side of the exemplary purse hook shown in FIG. 1.
Figure 6:
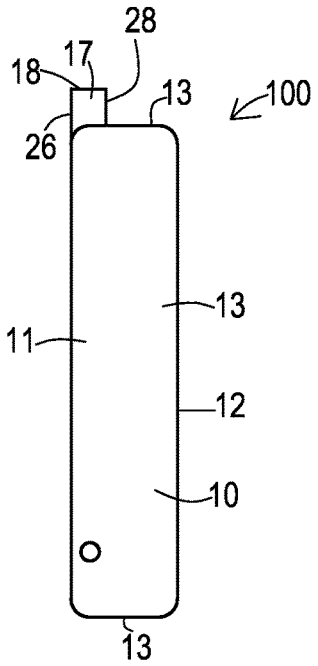
FIG. 6 depicts a side view of the exemplary purse hook shown in FIG. 1 as viewed from a right-hand side of the exemplary purse hook shown in FIG. 1.

49. The purse hook 100 of embodiment 48, wherein a first end 31 of said spring 30 is positioned within a first groove 32 that extends within said housing rear surface 12 of said purse hook housing 10. In one embodiment, groove 32 extends along a portion of housing rear surface 12 opposite a portion of hook channel 14 within housing front surface 11 of purse hook housing 10 (e.g., as shown in FIG. 2).

50. The purse hook 100 of embodiment 48 or 49, wherein a second end 33 of said spring 30 is positioned within a hole 34 drilled into an end wall 35 of said hook member 17.

Figure 16:
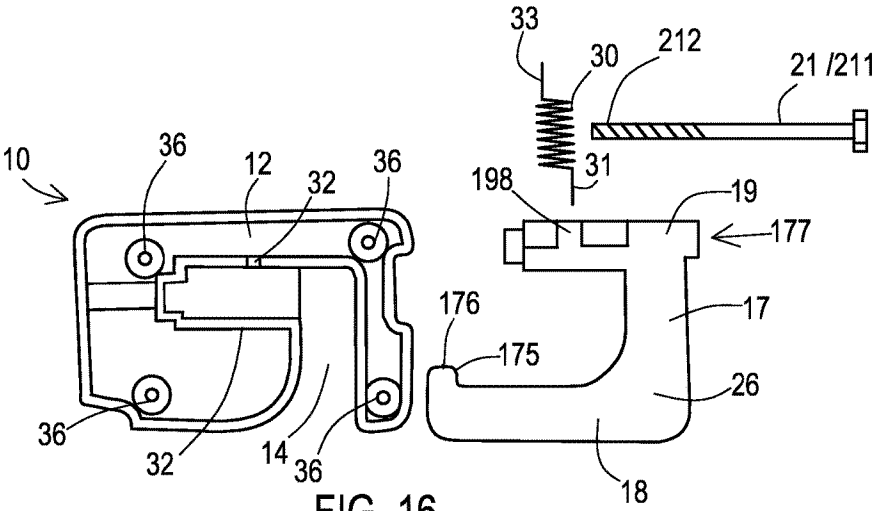
FIG. 16 depicts the combination of disassembled parts suitable for forming a purse hook of the present invention, the combination including (i) a rear view of an exemplary purse hook housing, (ii) an exemplary hook member, a bolt-like member, and a spring.
Figure 17:
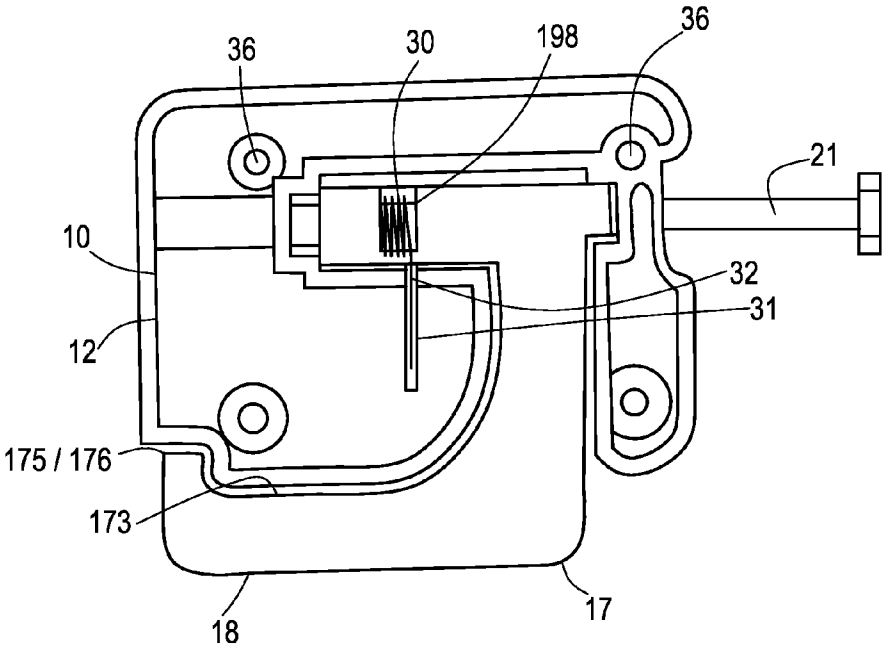
FIG. 17 depicts the combination of the parts shown in FIG. 13 in an assembled state.
Figure 18:
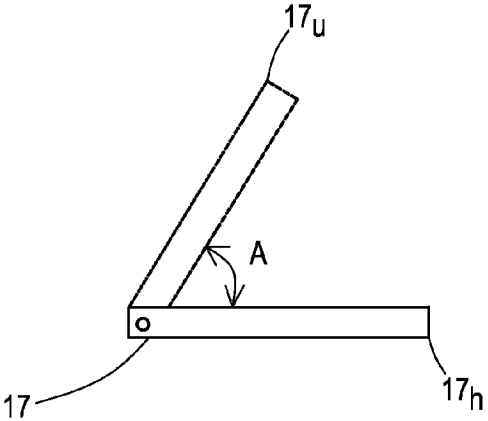
FIG. 18 depicts (i) a housed position and (ii) a use position of a hook member of an exemplary purse hook of the present invention.

51. The purse hook 100 of embodiment 48 or 49, wherein a second end 33 of said spring 30 is positioned within a second groove 32 that extends within said housing rear surface 12 of said purse hook housing 10, said second groove 32 being on an opposite side of said hook member 17 from said first groove 32. As shown in FIGS. 16-17, in this exemplary embodiment, spring 30 is positioned along bolt-like member 211 and within a gap 198 within second end 19 of hook member 17 with gap 198 being in fluid communication with hook member hole 177. First end 31 of spring 30 extends within first groove 32, while second end 33 extends along or within second groove 32 on an opposite side of hook member 17 from first groove 32. Desirably, spring 30 and gap 198 are positioned within a centrally located area of purse hook 100 as shown in FIG. 17.

52. The purse hook 100 of embodiment 50, wherein said end wall 35 of said hook member 17 is positioned between said two hook member extensions 20.

53. The purse hook 100 of any one of embodiments 1 to 52, wherein said purse hook housing 10 further comprises one or more holes 36 extending through said purse hook housing 10 from said housing front surface 11 to said housing rear surface 12, said one or more holes 36 not being in communication with said hook channel 14.

54. The purse hook 100 of any one of embodiments 1 to 53, wherein said purse hook housing 10 has an overall square or rectangular shape.

55. The purse hook 100 of any one of embodiments 1 to 54, wherein said purse hook housing 10 has an overall rectangular shape.

56. The purse hook 100 of any one of embodiments 1 to 55, wherein said purse hook housing 10 comprises a polymeric material, a metallic material, a cellulosic material, or any combination thereof. Suitable polymeric materials include, but are not limited to, polyvinyl chloride, polyester, polyolefin, or any combination thereof. The polymeric material may be a sold material or in the form of a foam material. Suitable metallic materials include, but are not limited to, aluminum, stainless steel, steel, or any combination thereof.

57. The purse hook 100 of any one of embodiments 1 to 56, wherein said hook member 17 comprises a polymeric material, a metallic material, a cellulosic material, or any combination thereof. Suitable polymeric materials include, but are not limited to, polyvinyl chloride, polyester, polyolefin, or any combination thereof. Suitable metallic materials include, but are not limited to, aluminum, stainless steel, steel, or any combination thereof.

58. The purse hook 100 of any one of embodiments 1 to 57, wherein said purse hook housing 10 comprises a polymeric material, and said hook member 17 comprises a polymeric material.

59. The purse hook 100 of any one of embodiments 1 to 57, wherein said purse hook housing 10 comprises a polymeric material, and said hook member 17 comprises a metallic material.

60. The purse hook 100 of any one of embodiments 1 to 57 and 59, wherein said purse hook housing 10 comprises a polyvinyl chloride, and said hook member 17 comprises aluminum.

61. The purse hook 100 of any one of embodiments 1 to 60, wherein said purse hook housing 10 has an overall housing thickness $t_{phh}$ of less than about 30 millimeters (mm).

62. The purse hook 100 of any one of embodiments 1 to 61, wherein said purse hook housing 10 has an overall housing thickness $t_{phh}$ of from about 8.0 mm to about 20 mm.

63. The purse hook 100 of any one of embodiments 1 to 62, wherein said purse hook housing 10 has an overall housing thickness $t_{phh}$ of from about 12 mm to about 15 mm.

64. The purse hook 100 of any one of embodiments 1 to 63, wherein said purse hook housing 10 has an overall width $W_{phh}$ ranging from about 8.0 centimeters (cm) to about 14 cm, and an overall length $L_{phh}$ ranging from about 6.0 cm to about 9.0 cm.

65. The purse hook 100 of any one of embodiments 1 to 64, wherein said purse hook housing 10 has an overall width $W_{phh}$ of about 12 cm, and an overall length $L_{phh}$ of about 7.0 cm.

66. The purse hook of any one of embodiments 1 to 65, wherein said hook member 17 has an overall width $W_{hm}$ ranging from about 7.0 cm to about 12 cm, and an overall length $L_{hm}$ ranging from about 6.0 cm to about 9.0 cm.

67. The purse hook 100 of any one of embodiments 1 to 66, wherein said purse hook housing 10 has an overall width $W_{phh}$ of about 8.4 cm, and an overall length $L_{phh}$ of about 7.0 cm.

68. The purse hook 100 of any one of embodiments 1 to 4 and 6 to 67, wherein said purse hook 100 further comprises a track system 202 sized to attach to an underside 203 of a table 200, said track system 202 enabling said purse hook housing 10 to move towards or away from an outer edge 201 of the table 200 by applying a moving force onto said purse hook housing 10.

Methods of Making Purse Hooks:

69. A method of making the purse hook 100 of any one of embodiments 1 to 68.

70. A method of making a purse hook 100, said method comprising: (I) forming a purse hook housing 10 comprising: (1) a housing front surface 11, a housing rear surface 12 opposite the housing front surface 11, and a housing peripheral surface 13 connecting the housing front surface 11 to the housing rear surface 12, the housing peripheral surface 13 representing an overall housing thickness $t_{phh}$ of the purse hook housing 10; and (2) a hook channel 14 extending within the housing front surface 11, the hook channel 14 having (i) a channel depth $d_{hc}$ that is equal to or less than the overall housing thickness $t_{phh}$ of the purse hook housing 10, and (ii) a channel shape; and (II) attaching a hook member 17 to the purse hook housing 10, the hook member 17 having a hook size and shape so as to enable the hook member 17 to move from (a) a housed position in which an inner peripheral side surface 173 of the hook member 17 is adjacent to at least one of: (1) the housing peripheral surface 13 and (2) an outwardly-facing channel wall 143 of the hook channel 14 to (b) a use position in which the inner peripheral side surface 173 of the hook member 17 is not adjacent to and is positioned a distance away from at least one of: (1) the housing peripheral surface 13 and (2) the outwardly-facing channel wall 143.

71. A method of making a purse hook 100, said method comprising: (I) forming a purse hook housing 10 comprising: (1) a housing front surface 11, a housing rear surface 12 opposite the housing front surface 11, and a housing peripheral surface 13 connecting the housing front surface 11 to the housing rear surface 12, the housing peripheral surface 13 representing an overall housing thickness $t_{phh}$ of the purse hook housing 10; (2) a hook channel 14 extending within the housing front surface 11, the hook channel 14 having (i) a channel depth $d_{hc}$ that is less than the overall housing thickness $t_{phh}$ of the purse hook housing 10, and (ii) a channel shape; and (3) a housing aperture 15 extending through the purse hook housing 10 from the housing front surface 11 to the housing rear surface 12, the housing aperture 15 being in communication with the hook channel 14 (i.e., at least a portion of the hook channel 14 intersects with the hook aperture 15, i.e., a channel edge 16 extends along both hook channel 14 and housing aperture 15); and (II) attaching a hook member 17 to the purse hook housing 10, the hook member 17 having a hook size and shape so as to enable the hook member 17 to move from (a) a housed position (as shown in FIGS. 1-6) within the purse hook housing 10 to (b) a use position in which the hook member 17 is positioned outside of the purse hook housing 10.

72. A method of making a purse hook 100, said method comprising: (I) forming a purse hook housing 10 comprising: (1) a housing front surface 11, a housing rear surface 12 opposite the housing front surface 11, and a housing peripheral surface 13 connecting the housing front surface 11 to the housing rear surface 12, the housing peripheral surface 13 representing an overall housing thickness $t_{phh}$ of the purse hook housing 10; and (2) a hook channel 14 extending within the housing front surface 11, the hook channel 14 having (i) a channel depth $d_{hc}$ that is equal to or less than the overall housing thickness $t_{phh}$ of the purse hook housing 10, and (ii) a channel shape; (II) forming a hook member 17 having a hook size and shape so as to enable the hook member 17 to move from (a) a housed position (as shown in FIGS. 1-6) within the purse hook housing 10 to (b) a use position in which the hook member 17 is positioned outside of the purse hook housing 10 the hook member 17 comprising (i) a first hook member end 18, (ii) a second hook member end 19 connected to the purse hook housing 10, and (iii) two hook member extensions 20 extending away from the first hook member end 18.

73. A method of making a purse hook 100, said method comprising: (I) forming a purse hook housing 10 comprising: (1) a housing front surface 11, a housing rear surface 12 opposite the housing front surface 11, and a housing peripheral surface 13 connecting the housing front surface 11 to the housing rear surface 12, the housing peripheral surface 13 representing an overall housing thickness $t_{phh}$ of the purse hook housing 10; and (2) a hook channel 14 extending within the housing front surface 11, the hook channel 14 having (i) a channel depth $d_{hc}$ that is equal to or less than the overall housing thickness $t_{phh}$ of the purse hook housing 10, and (ii) a channel shape; (II) forming a hook member 17 having a hook size and shape so as to enable the hook member 17 to move from (a) a housed position (as shown in FIGS. 1-6) within the purse hook housing 10 to (b) a use position in which the hook member 17 is positioned outside of the purse hook housing 10, the hook member 17 comprising (i) a first hook member end 18 comprising two hook components 171 extending in opposite directions towards outer edges of the purse hook housing 10 from a centrally located hook connecting component 172, the centrally located hook connecting component 172 extending to (ii) a second hook member end 19 connected to the purse hook housing 10.

74. A method of making a purse hook 100, said method comprising: (I) forming a purse hook housing 10 comprising: (1) a housing front surface 11, a housing rear surface 12 opposite the housing front surface 11, and a housing peripheral surface 13 connecting the housing front surface 11 to the housing rear surface 12, the housing peripheral surface 13 representing an overall housing thickness $t_{phh}$ of the purse hook housing 10; and (2) a hook channel 14 extending within the housing front surface 11, the hook channel 14 having (i) a channel depth $d_{hc}$ that is equal to or less than the overall housing thickness $t_{phh}$ of the purse hook housing 10, and (ii) a channel shape; (II) forming a hook member 17 having a hook size and shape so as to enable the hook member 17 to move from (a) a housed position (as shown in FIGS. 1-6) within the purse hook housing 10 to (b) a use position in which the hook member 17 is positioned outside of the purse hook housing 10, the hook member 17 comprising (i) a first hook member end 18, and (ii) a second hook member end 19 connected to the purse hook housing 10; and (III) providing a track system 202 sized to attach to an underside 203 of a table 200, the track system 202 enabling the purse hook housing 10 to move towards or away from an outer edge 201 of the table 200 by applying a moving force onto the purse hook housing 10.

75. The method of any one of embodiments 69 and 71 to 74, wherein the hook member 17 has a hook size and shape so as to enable the hook member 17 to move from (a) a housed position in which an inner peripheral side surface 173 of the hook member 17 is adjacent to at least one of: (1) the housing peripheral surface 13 and (2) an outwardly-facing channel wall 143 of the hook channel 14 to (b) a use position in which the inner peripheral side surface 173 of the hook member 17 is not adjacent to and is positioned a distance away from at least one of: (1) the housing peripheral surface 13 and (2) the outwardly-facing channel wall 143.

76. The method of embodiment 69 or 75, wherein when the hook member 17 is in the use position, the inner peripheral side surface 173 of the hook member 17 is pivotally positioned a distance from at least one of: (1) the housing peripheral surface 13 and (2) the outwardly-facing channel wall 143.

77. The method of any one of embodiments 69 and 75 to 76, wherein when the hook member 17 is in the use position, the inner peripheral side surface 173 of the hook member 17 is positioned within a plane that forms an angle with the housed position of the hook member 17, the angle being less than 180°.

78. The method of any one of embodiments 69 and 75 to 77, wherein when the hook member 17 is in the use position, the inner peripheral side surface 173 of the hook member 17 is positioned within a plane that forms an angle with the housed position of the hook member 17, the angle ranging from about 45° to about 150°.

79. The method of any one of embodiments 69 and 75 to 78, wherein when the hook member 17 is in the use position, the inner peripheral side surface 173 of the hook member 17 is positioned within a plane that forms an angle with the housed position of the hook member 17, the angle being about 90°.

80. The method of any one of embodiments 69 to 70 and 72 to 79, wherein the hook channel 14 has a channel depth $d_{hc}$ that is equal to the overall housing thickness $t_{phh}$ of the purse hook housing 10.

81. The method of any one of embodiments 69 and 75 to 80, wherein the hook member 17 has a hook size and shape such that the inner peripheral side surface 173 of the hook member 17 is adjacent to the housing peripheral surface 13 when the hook member 17 is in the housed position, and the inner peripheral side surface 173 is positioned a distance away from the housing peripheral surface 13 when in the use position.

82. The method of any one of embodiments 69 and 75 to 81, wherein the hook member 17 comprises (i) a first hook member end 18 having a hook end tip 175, and (ii) a second hook member end 19 connected to the purse hook housing 10, and an inner peripheral side tip surface 176 of the hook end tip 175 is adjacent to the housing peripheral surface 13 when the hook member 17 is in the housed position, and the inner peripheral side tip surface 176 of the hook end tip 175 is positioned a distance away from the housing peripheral surface 13 when in the use position.

83. The method of any one of embodiments 69 and 75 to 82, wherein the housing peripheral surface 13 extends along first and second housing peripheral surface portions 13*a* and 13*b* on opposite sides of the hook housing 10, the inner peripheral side surface 173 of the hook member 17 is adjacent to and extends along one of the first and second housing peripheral surface portions 13*a* and 13*b*, and the first and second housing peripheral surface portions 13*a* and 13*b* of the hook housing 10 are substantially parallel with one another.

84. The method of any one of embodiments 69 to 70, 72 to 79 and 81 to 83, wherein said step of forming the purse hook housing 10 further comprises forming a housing aperture 15 extending through the purse hook housing 10 from the housing front surface 11 to the housing rear surface 12, the housing aperture 15 being in communication with the hook channel 14.

85. The method of any one of embodiments 69 to 84, wherein the hook member 17 comprising (i) a first hook member end 18 that extends beyond the housing peripheral surface 13 of the purse hook housing 10 when the hook member 17 is in the housed position, and (ii) a second hook member end 19 connected to the purse hook housing 10.

86. The method of any one of embodiments 69 to 70 and 72 to 85, wherein the hook member 17 comprises two hook member extensions 20 extending away from the first hook member end 18.

87. The method of any one of embodiments 69 to 86, wherein said method further comprises: connecting the hook member 17 to the purse hook housing 10 via at least one connecting member 21 extending through the hook member 17 at the second hook member end 19.

88. The method of embodiment 87, wherein the at least one connecting member 21 extends through portions of each of the two hook member extensions 20 and into side walls 22 of the hook channel 14 within the purse hook housing 10.

89. The method of any one of embodiments 69 to 79 and 81 to 88, wherein the channel depth $d_{hc}$ extends into the housing front surface 11 a depth amount of up to about 70% of the overall housing thickness $t_{phh}$ of the purse hook housing 10.

90. The method of any one of embodiments 69 to 79 and 81 to 89, wherein the channel depth $d_{hc}$ extends into the housing front surface 11 a depth amount of from about 40% to about 60% of the overall housing thickness $t_{phh}$ of the purse hook housing 10.

91. The method of any one of embodiments 69 to 79 and 81 to 90, wherein the channel depth $d_{hc}$ extends into the housing front surface 11 a depth amount of from about 6.0 to about 8.0 mm.

92. The method of any one of embodiments 69 to 79 and 81 to 91, wherein the hook channel 17 has a channel floor 23 that is substantially within a first plane, the first plane being substantially parallel with (1) outermost portions of the housing front surface 11 and (2) the housing rear surface 12.

93. The method of any one of embodiments 69 to 92, wherein the channel shape, as viewed from the housing front surface 11, extends (i) along a portion 24 of the housing peripheral surface 13, the portion 24 of the housing peripheral surface 13 representing up to about 90% of an overall width $W_{phh}$ of the purse hook housing 10, and (ii) from the portion 24 of the housing peripheral surface 13 into the purse hook housing 10 in a length direction L, wherein at least a portion of the hook channel 14 extends at least 50% of an overall length $L_{phh}$ of the purse hook housing 10.

94. The method of any one of embodiments 69 to 93, wherein the channel shape, as viewed from the housing front surface 11, extends (i) along a portion 24 of the housing peripheral surface 13, the portion 24 of the housing peripheral surface 13 representing from about 60% to about 90% of an overall width $W_{phh}$ of the purse hook housing 10, and (ii) from the portion 24 of the housing peripheral surface 13 into the purse hook housing 10 in a length direction L, wherein at least a portion of the hook channel 14 extends from about 55% to about 75% of an overall length $L_{phh}$ of the purse hook housing 10.

95. The method of any one of embodiments 69 to 94, wherein the channel shape, as viewed from the housing front surface 11, extends (i) along a portion 24 of the housing peripheral surface 13, the portion 24 of the housing peripheral surface 13 representing about 75% of an overall width $W_{phh}$ of the purse hook housing 10, and (ii) from the portion 24 of the housing peripheral surface 13 into the purse hook housing 10 in a length direction L, wherein at least a portion of the hook channel 14 extends about 67% of an overall length $L_{phh}$ of the purse hook housing 10.

96. The method of any one of embodiments 69, 71, 75 to 79 and 81 to 95, wherein the channel shape extends from a portion 24 of the housing peripheral surface 13 to the housing aperture 15.

97. The method of any one of embodiments 69 to 96, wherein the housing aperture 15 has a rectangular shape with a longest dimension extending along a width $W_{phh}$ of the purse hook housing 10, and a smaller dimension extending along a length $L_{phh}$ of the purse hook housing 10.

98. The method of any one of embodiments 69, 71, 75 to 79 and 81 to 97, wherein the housing aperture 15 has an overall aperture width $W_a$ that is substantially equal to an overall hook channel width $W_{hc}$.

99. The method of any one of embodiments 69, 71, 75 to 79 and 81 to 98, wherein the housing aperture 15 has an overall aperture width $W_a$ that is substantially equal to the portion 24 of the peripheral surface 13. See, for example, FIG. 7.

100. The method of any one of embodiments 69, 71, 75 to 79 and 81 to 99, wherein the housing aperture 15 has an overall aperture length $L_a$ that is up to about 40% of an overall length $L_{phh}$ of the purse hook housing 10.

101. The method of any one of embodiments 69, 71, 75 to 79 and 81 to 100, wherein the housing aperture 15 has an overall aperture length $L_a$ that is about 28% of an overall length $L_{phh}$ of the purse hook housing 10.

102. The method of any one of embodiments 69 to 101, wherein the channel shape, as viewed from the housing front surface 11, has a J-shape.

103. The method of any one of embodiments 69 to 102, wherein the hook member 17 has (i) a first major surface 26 extending along an outer surface 26 of the hook member 17 when the hook member 17 is in the housed position, and (ii) a second major surface 28 opposite the first major surface 26, the second major surface 26 extending along the hook channel 14 when the hook member 17 is in the housed position. As noted above, inner peripheral side surface 173 of hook member 17 separates a portion of first major surface 26 from a portion of second major surface 28 along hook member 17.

104. The method of any one of embodiments 69 to 103, wherein the hook member 17 has (i) a first major surface 26 extending along an outer surface 26 of the hook member 17 when the hook member 17 is in the housed position, and (ii) a second major surface 28 opposite the first major surface 26, the second major surface 26 extending along the hook channel 14 when the hook member 17 is in the housed position, the first major surface 26 and the second major surface 28 both being substantially flat with the first major surface 26 being in a second plane and the second major surface 28 being in a third plane, the second and third planes being substantially parallel with one another.

105. The method of any one of embodiments 69 to 72 and 74 to 104, wherein the hook member 17 has (i) a first hook member end 18 comprising two hook components 171 extending in opposite directions towards outer edges of said purse hook housing 10 from a centrally located hook connecting component 172, said centrally located hook connecting component 172 extending to (ii) a second hook member end 19 connected to said purse hook housing 10.

106. The method of any one of embodiments 69 to 105, wherein the hook member 17 has an overall thickness $t_{hm}$ that is less than about 90% of the overall housing thickness $t_{phh}$ of the purse hook housing 10 (or an overall thickness $t_{hm}$ that is any percent less than about 90%, in increments of 1.0%, down to about 5.0% of the overall housing thickness $t_{phh}$ of the purse hook housing 10).

107. The method of any one of embodiments 69 to 106, wherein the hook member 17 has an overall thickness $t_{hm}$ that is from about 30% to about 50% of the overall housing thickness $t_{phh}$ of the purse hook housing 10.

108. The method of any one of embodiments 69 to 107, wherein the hook member 17 has an overall thickness $t_{hm}$ that is about 40% of the overall housing thickness $t_{phh}$ of the purse hook housing 10.

109. The method of any one of embodiments 87 to 108, wherein the at least one connecting member 21 comprises a single connecting member 21.

110. The method of embodiment 109, wherein the single connecting member 21 comprises a bolt-like member with a threaded end, the bolt-like member extending thru a hook member hole extending along a width of the hook member 17.

111. The method of any one of embodiments 87 to 108, wherein the at least one connecting member 21 comprises two separate connecting members 21.

112. The method of embodiment 111, wherein each of the two separate connecting members 21 comprises a screw 21.

113. The method of any one of embodiments 69 to 112, further comprising incorporating at least one tensioning device 30 into the purse hook 100, wherein the at least one tensioning device 30 applies a housing force onto the hook member 17 so as to keep the hook member 17 within the hook channel 14, in the use position, until an outside force moves the hook member 17 out of the use position.

114. The method of any one of embodiments 69 to 113, further comprising incorporating two tensioning devices 30 into the purse hook 100, wherein the two tensioning devices 30 apply a housing force onto the hook member 17 so as to keep the hook member 17 within the hook channel 14, in the use position, until an outside force moves the hook member 17 out of the use position.

115. The method of any one of embodiments 69 to 113, further comprising a single tensioning device 30 that applies a housing force onto the hook member 17 so as to keep the hook member 17 within the hook channel 14, in the use position, until an outside force moves the hook member 17 out of the use position.

116. The method of embodiment 113 or 114, wherein each tensioning device 30 is positioned along the at least one connecting member 21.

117. The method of any one of embodiments 113 to 116, wherein each tensioning device 30 comprises a spring 30.

118. The method of embodiment 117, wherein a first end 31 of the spring 30 is positioned within a groove 32 that extends within the housing rear surface 12 of the purse hook housing 10. See, groove 32 in FIG. 2.

119. The method of embodiment 116 or 117, wherein a second end 33 of the spring 30 is positioned within a second groove 32 that extends within the housing rear surface 12 of the purse hook housing 10, the second groove being on an opposite side of the hook member 17 from the first groove 32. See, for example, FIG. XXX.

120. The method of embodiment 116 or 117, wherein a second end 33 of the spring 30 is positioned within a hole 34 drilled into an end wall 35 of the hook member 17.

121. The method of embodiment 120, wherein the end wall 35 of the hook member 17 is positioned between the two hook member extensions 20.

122. The method of any one of embodiments 69 to 121, wherein said step of forming the purse hook housing 10 further comprises forming one or more holes 36 extending through the purse hook housing 10 from the housing front surface 11 to the housing rear surface 12, the one or more holes 36 not being in communication with the hook channel 14.

123. The method of any one of embodiments 69 to 122, wherein the purse hook housing 10 has an overall square or rectangular shape.

124. The method of any one of embodiments 69 to 123, wherein the purse hook housing 10 has an overall rectangular shape.

125. The method of any one of embodiments 69 to 124, wherein the purse hook housing 10 comprises a polymeric material, a metallic material, a cellulosic material, or any combination thereof.

126. The method of any one of embodiments 69 to 125, wherein the hook member 17 comprises a polymeric material, a metallic material, a cellulosic material, or any combination thereof.

127. The method of any one of embodiments 69 to 126, wherein the purse hook housing 10 comprises a polymeric material, and the hook member 17 comprises a polymeric material.

128. The method of any one of embodiments 69 to 127, wherein the purse hook housing 10 comprises a polymeric material, and the hook member 17 comprises a metallic material.

129. The method of any one of embodiments 59 to 126 and 128, wherein the purse hook housing 10 comprises a polyvinyl chloride, and the hook member 17 comprises aluminum.

130. The method of any one of embodiments 69 to 129, wherein the purse hook housing 10 has an overall housing thickness $t_{phh}$ of less than about 30 mm.

131. The method of any one of embodiments 69 to 130, wherein the purse hook housing 10 has an overall housing thickness $t_{phh}$ of from about 8.0 mm to about 20 mm.

132. The method of any one of embodiments 69 to 131, wherein the purse hook housing 10 has an overall housing thickness $t_{phh}$ of from about 12 mm to about 15 mm.

133. The method of any one of embodiments 69 to 132, wherein the purse hook housing 10 has an overall width $W_{phh}$ ranging from about 8.0 cm to about 14 cm, and an overall length $L_{phh}$ ranging from about 6.0 cm to about 9.0 cm.

134. The method of any one of embodiments 69 to 133, wherein the purse hook housing 10 has an overall width $W_{phh}$ of about 12 cm, and an overall length $L_{phh}$ of about 7.0 cm.

135. The method of any one of embodiments 69 to 134, wherein the hook member 17 has an overall width $W_{hm}$ ranging from about 7.0 cm to about 12 cm, and an overall length $L_{hm}$ ranging from about 6.0 cm to about 9.0 cm.

136. The method of any one of embodiments 69 to 135, wherein the purse hook housing 10 has an overall width of about 8.4 cm, and an overall length of about 7.0 cm.

137. The method of any one of embodiments 69 to 73 and 75 to 136, further comprising: providing a track system 202 sized to attach to an underside 203 of a table 200, the track system 202 enabling the purse hook housing 10 to move towards or away from an outer edge 201 of the table 200 by applying a moving force onto the purse hook housing 10.

138. The method of any one of embodiments 69 to 73 and 75 to 137, further comprising: attaching the purse hook housing 10 to the track system 202.

Methods of Using Purse Hooks:

139. A method of using the purse hook 100 of any one of embodiments 1 to 68, said method comprising: attaching the purse hook 100 to a substrate (e.g., an underside surface 203 of a table 200 shown in FIG. 12).

140. The method of embodiment 139, wherein the substrate comprises a wall surface, a table surface, a bar surface, a ceiling surface, or a desk surface.

141. The method of embodiment 139 or 140, wherein the substrate comprises a table surface.

142. The method of any one of embodiments 139 to 141, wherein the substrate comprises a table surface along an underside of the table.

143. The method of any one of embodiments 139 to 142, further comprising: apply a moving force onto the hook member 17 so as to move the hook member 17 from the housed position so that a majority of the hook member 17 extends from the purse hook housing 10.

144. The method of any one of embodiments 139 to 143, further comprising: positioning a portion of an object (not shown) over the hook member 17 extending from the purse hook housing 10.

145. The method of embodiment 144, wherein the object comprises a purse, a computer bag, a cell phone case component, a suitcase, or an umbrella.

146. The method of embodiment 144 or 145, wherein the object comprises a purse.

147. The method of any one of embodiments 139 to 146, further comprising: apply a moving force onto the purse hook housing to move the purse hook housing along a track system so as to move the purse hook housing along the track system.

148. The method of embodiment 147, wherein the track system is along an underside of a table and the moving force moves the purse hook housing towards or away from an outer edge of the table.

In addition, it should be understood that although the above-described purse hooks, purse hook components/features, and methods are described as "comprising" one or more components or steps, the above-described purse hooks, purse hook components/features, and methods may "comprise," "consists of," or "consist essentially of" the above-described components or steps of the purse hooks, purse hook components/features, and methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a purse hook, purse hook component/feature, and/or method that "comprises" a list of elements (e.g., components or steps) is not necessarily limited to only those elements (or components or steps), but may include other elements (or components or steps) not expressly listed or inherent to the purse hook, purse hook component/feature, and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a purse hook, a purse hook component/feature, and/or a method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

Further, it should be understood that the herein-described purse hooks, purse hook components/features, and/or methods may comprise, consist essentially of, or consist of any of the herein-described components and features, as shown in the figures with or without any feature(s) not shown in the figures. In other words, in some embodiments, the purse hooks or purse hook components of the present invention do not have any additional features other than those shown in the figures, and such additional features, not shown in the figures, are specifically excluded from the purse hooks or purse hook components. In other embodiments, the purse hooks or purse hook components of the present invention do have one or more additional features that are not shown in the figures.

The present invention is described above and further illustrated below by way of examples, which are not to be construed in any way as imposing limitations upon the scope of the invention. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLES

Example 1

Exemplary purse hooks of the present invention, such as those detailed in FIGS. 1-17 and described above, were prepared and utilized in several restaurants to securely hold purses under the tables of the restaurants.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A purse hook comprising:

(I) a purse hook housing comprising:

(1) a housing front surface, a housing rear surface opposite said housing front surface, and a housing peripheral surface connecting said housing front surface to said housing rear surface, at least a portion of said housing peripheral surface representing an overall housing thickness $t_{phh}$ of said purse hook housing; and (2) a hook channel extending within said housing, said hook channel having (i) a channel depth $d_{hc}$ that is equal to or less than said overall housing thickness $t_{phh}$ of said purse hook housing, and (ii) a channel shape;

(II) a hook member attached to said purse hook housing, said hook member having a hook size and shape so as to enable said hook member to move from (a) a housed position in which an inner peripheral side surface of said hook member is adjacent to at least one of: (1) said housing peripheral surface and (2) an outwardly-facing channel wall of said hook channel to (b) a use position in which said inner peripheral side surface of said hook member is not adjacent to and is positioned a distance away from at least one of: (1) said housing peripheral surface and (2) said outwardly-facing channel wall; and (III) at least one connecting member extending through said hook member, wherein said at least one connecting member comprises a single connecting member, and said single connecting member comprises a bolt-like member with a threaded end, said bolt-like member extending thru a hook member hole extending along a width of said hook member.

2. The purse hook of claim 1, wherein when said hook member is in the use position, said inner peripheral side surface of said hook member is pivotally positioned a distance from at least one of: (1) said housing peripheral surface and (2) said outwardly-facing channel wall.

3. The purse hook of claim 1, wherein when said hook member is in the use position, said inner peripheral side surface of said hook member is positioned within a plane that forms an angle with the housed position of said hook member, said angle being less than 180°.

4. The purse hook of claim 3, wherein when said hook member is in the use position, said inner peripheral side surface of said hook member is positioned within a plane that forms an angle with the housed position of said hook member, said angle ranging from about 45° to about 150°.

5. The purse hook of claim 4, wherein when said hook member is in the use position, said inner peripheral side surface of said hook member is positioned within a plane that forms an angle with the housed position of said hook member, said angle being about 90°.

6. The purse hook of claim 1, wherein said hook channel has a channel depth $d_{hc}$ that extends from said housing front surface to said housing rear surface of said purse hook housing.

7. The purse hook of claim 1, wherein said hook member has a hook size and shape such that said inner peripheral side surface of said hook member is adjacent to said housing peripheral surface when said hook member is in the housed position, and said inner peripheral side surface is positioned a distance away from said housing peripheral surface when in the use position.

8. The purse hook of claim 1, wherein said hook member comprises (i) a first hook member end having a hook end tip, and (ii) a second hook member end connected to said purse hook housing via said single connecting member, and an inner peripheral side tip surface of said hook end tip is adjacent to said housing peripheral surface when said hook member is in the housed position, and said inner peripheral side tip surface of said hook end tip is positioned a distance away from said housing peripheral surface when in the use position.

9. The purse hook of claim 1, wherein said housing peripheral surface extends along first and second housing peripheral surface portions and on opposite sides of said hook housing, said inner peripheral side surface of said hook member is adjacent to and extends along one of said first and second housing peripheral surface portions and, and said first and second housing peripheral surface portions and of said hook housing are substantially parallel with one another.

10. The purse hook of claim 1, wherein said hook member comprising (i) a first hook member end that extends beyond said housing peripheral surface of said purse hook housing when said hook member is in the housed position, and (ii) a second hook member end connected to said purse hook housing.

11. The purse hook of claim 1, wherein said hook member has (i) a first hook member end comprising two hook components extending in opposite directions towards outer edges of said purse hook housing from a centrally located hook connecting component, said centrally located hook connecting component extending to (ii) a second hook member end connected to said purse hook housing via said single connecting member.

12. The purse hook of claim 1, wherein said purse hook further comprises a track system sized to attach to an underside of a table, said track system enabling said purse hook housing to move towards or away from an outer edge of the table by applying a moving force onto said purse hook housing.

13. A purse hook comprising:

(I) a purse hook housing comprising:

(1) a housing front surface, a housing rear surface opposite said housing front surface, and a housing peripheral surface connecting said housing front surface to said housing rear surface, at least a portion of said housing peripheral surface representing an overall housing thickness $t_{phh}$ of said purse hook housing; and (2) a hook channel extending within said housing front surface, said hook channel having (i) a channel depth $d_{hc}$ that is equal to or less than said overall housing thickness $t_{phh}$ of said purse hook housing, and (ii) a channel shape;

(II) a hook member attached to said purse hook housing, said hook member having a hook size and shape so as to enable said hook member to move from (a) a housed position in which an inner peripheral side surface of said hook member is adjacent to at least one of: (1) said housing peripheral surface and (2) an outwardly-facing channel wall of said hook channel to (b) a use position in which said inner peripheral side surface of said hook member is not adjacent to and is positioned a distance away from at least one of: (1) said housing peripheral surface and (2) said outwardly-facing channel wall; and (III) a single tensioning device that applies a housing force onto said hook member so as to keep said hook member within said hook channel, in the use position, until an outside force moves said hook member out of the use position, wherein said single tensioning device comprises a spring, and a first end of said spring is positioned within a first groove that extends within said housing rear surface of said purse hook housing, and a second end of said spring is either (i) positioned within a hole drilled into an end wall of said hook member, or (ii) positioned within a second groove that extends within said housing rear surface of said purse hook housing, said second groove being on an opposite side of said hook member from said first groove.

14. The purse hook of claim 1, wherein said channel shape, as viewed from said housing front surface, has a J-shape.

15. The purse hook of claim 13, wherein said hook channel has a channel depth $d_{hc}$ that extends from said housing front surface to said housing rear surface of said purse hook housing.

16. The purse hook of claim 13, wherein said hook member has a hook size and shape such that said inner peripheral side surface of said hook member is adjacent to said housing peripheral surface when said hook member is in the housed position, and said inner peripheral side surface is positioned a distance away from said housing peripheral surface when in the use position.

17. The purse hook of claim 13, wherein said hook member has (i) a first hook member end comprising two hook components extending in opposite directions towards outer edges of said purse hook housing from a centrally located hook connecting component, said centrally located hook connecting component extending to (ii) a second hook member end connected to said purse hook housing via said single connecting member.

18. The purse hook of claim 13, wherein said purse hook further comprises a track system sized to attach to an underside of a table, said track system enabling said purse hook housing to move towards or away from an outer edge of the table by applying a moving force onto said purse hook housing.

19. A purse hook comprising:

(I) a purse hook housing comprising:

(1) a housing front surface, a housing rear surface opposite said housing front surface, and a housing peripheral surface connecting said housing front surface to said housing rear surface, at least a portion of said housing peripheral surface representing an overall housing thickness $t_{phh}$ of said purse hook housing; and (2) a hook channel extending within said housing, said hook channel having (i) a channel depth $d_{hc}$ that extends from said housing front surface to said housing rear surface of said purse hook housing, and (ii) a channel shape;

(II) a hook member attached to said purse hook housing, said hook member having a hook size and shape so as to enable said hook member to move from (a) a housed position in which an inner peripheral side surface of said hook member is adjacent to at least one of: (1) said housing peripheral surface and (2) an outwardly-facing channel wall of said hook channel to (b) a use position in which said inner peripheral side surface of said hook member is not adjacent to and is positioned a distance away from at least one of: (1) said housing peripheral surface and (2) said outwardly-facing channel wall;

(III) a single connecting member, said single connecting member comprising a bolt-like member with a threaded end, said bolt-like member extending thru a hook member hole extending along a width of said hook member; and (IV) a single tensioning device that applies a housing force onto said hook member so as to keep said hook member within said hook channel, in the use position, until an outside force moves said hook member out of the use position.

20. The purse hook of claim 19, wherein said hook member comprises (i) a first hook member end having a hook end tip, and (ii) a second hook member end connected to said purse hook housing, and an inner peripheral side tip surface of said hook end tip is adjacent to said housing peripheral surface when said hook member is in the housed position, and said inner peripheral side tip surface of said hook end tip is positioned a distance away from said housing peripheral surface hen in the use position.

* * * * *